US007209100B1

(12) United States Patent
Suzuki

(10) Patent No.: US 7,209,100 B1
(45) Date of Patent: Apr. 24, 2007

(54) METHOD FOR DRIVING DISPLAY PANEL

(75) Inventor: Masahiro Suzuki, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/560,891

(22) Filed: Apr. 28, 2000

(30) Foreign Application Priority Data

Apr. 28, 1999 (JP) ..... 11-122530

(51) Int. Cl.
*G09G 3/28* (2006.01)

(52) U.S. Cl. ..... 345/63; 345/77; 345/89; 345/690; 315/169.1; 315/169.3

(58) Field of Classification Search ..... 345/60–68, 345/55, 69, 690–693, 77, 89; 315/169.3, 315/169.4
See application file for complete search history.

(56) References Cited

U.S. PATENT DOCUMENTS 5,757,343 A * 5/1998 Nagakubo ..... 345/63
5,818,419 A * 10/1998 Tajima et al. ..... 345/691
5,854,540 A * 12/1998 Matsumoto et al. ..... 315/169.1
5,874,932 A * 2/1999 Nagaoka et al. ..... 345/60
5,914,563 A * 6/1999 Lee et al. ..... 313/585
6,052,101 A * 4/2000 Moon ..... 345/60
6,066,923 A * 5/2000 Noborio et al. ..... 315/169.4
6,072,447 A * 6/2000 Noborio ..... 345/60
6,100,939 A * 8/2000 Kougami et al. ..... 348/687
6,172,465 B1 * 1/2001 Huang ..... 315/169.3
6,175,194 B1 * 1/2001 Saegusa et al. ..... 315/169.4
6,297,788 B1 * 10/2001 Shigeta et al. ..... 345/63
6,320,326 B1 * 11/2001 Shino et al. ..... 315/169.4
6,369,782 B2 * 4/2002 Shigeta ..... 345/63
6,646,625 B1 * 11/2003 Shigeta et al. ..... 345/63

* cited by examiner

*Primary Examiner*—Richard Hjerpe
*Assistant Examiner*—Jennifer T Nguyen
(74) *Attorney, Agent, or Firm*—Sughrue Mion, PLLC

(57) ABSTRACT

Disclosed herein is a method for driving a display panel that provides excellent halftone brightness at low power consumption. A unit display period of a video signal is constituted by a plurality of divided display periods. In each of the divided display periods, the pixel data write process in which each of the pixel cells is set to either a light-emitting cell or a non-light-emitting cell in accordance with pixel data corresponding to the video signal is carried out. In addition, in each of the divided display periods, the light emission sustain process in which only the aforementioned light-emitting cell is allowed to emit light for the number corresponding to a weight assigned to each of the divided display periods is carried out. In accordance with the brightness level of the video signal, the number of light emissions that is to be assigned to each of the divided display periods is changed.

7 Claims, 35 Drawing Sheets

FIG. 7

SELECTIVE ERASE

| Ds | HD | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| 0000 | 1 | 0 | 0 | 0 | 0 | 0 | 0 | 0 | 0 | 0 | 0 | 0 | 0 | 0 |
| 0001 | 0 | 1 | 0 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 8A PL = "11" (183-255)

FIG. 8B PL = "10" (92-182)

FIG. 8C PL = "01" (0-91)

FIG. 10

SELECTIVE ERASE

| Ds | HD | | | | | | | | | | | | | | LIGHT EMISSION DRIVE PATTERN IN ONE FIELD | | | | | | | | | | | | | | BRIGHTNESS | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | (a) | (b) | (c) |
| 0000 | 1 | 0 | 0 | 0 | 0 | 0 | 0 | 0 | 0 | 0 | 0 | 0 | 0 | 0 | ● | | | | | | | | | | | | | | 0 | 0 | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 | 0 | 0 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 | 2 | 0 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 | 4 | 1 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 16 | 8 | 2 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 | 13 | 3 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 | 19 | 4 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 | 27 | 6 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 | 36 | 8 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 | 46 | 10 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 | 58 | 13 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 151 | 72 | 16 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 | 87 | 19 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 | 104 | 23 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 | 122 | 27 |

BLACK CIRCLE : SELECTIVE ERASE DISCHARGE
WHITE CIRCLE : LIGHT EMISSION

FIG. 11

SELECTIVE ERASE

| Ds | HD | | | | | | | | | | | | | | LIGHT EMISSION DRIVE PATTERN IN ONE FIELD | | | | | | | | | | | | | | BRIGHTNESS | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | (a) | (b) | (c) |
| 0000 | 1 | 1 | * | * | * | * | * | * | * | * | * | * | * | * | ● | ● | △ | △ | △ | △ | △ | △ | △ | △ | △ | △ | △ | △ | 0 | 0 | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 | 0 | 0 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 | 2 | 0 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 | 4 | 1 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 16 | 8 | 2 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 | 13 | 3 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 | 19 | 4 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 | 27 | 6 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 | 36 | 8 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 | 46 | 10 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 | 58 | 13 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 151 | 72 | 16 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 | 87 | 19 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 | 104 | 23 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 | 122 | 27 |

FIG. 14

| Ds | HD | | | | | LIGHT EMISSION DRIVE PATTERN | | | | | BRIGHT-NESS |
|---|---|---|---|---|---|---|---|---|---|---|---|
| | 1 | 2 | 3 | 4 | 5 | SF 1 | SF 2 | SF 3 | SF 4 | SF 5 | (c) |
| 0000 | 1 | 0 | 0 | 0 | 0 | ● | | | | | 0 |
| 0001 | 0 | 1 | 0 | 0 | 0 | ○ | ● | | | | 1 |
| 0010 | 0 | 0 | 1 | 0 | 0 | ○ | ○ | ● | | | 4 |
| 0011 | 0 | 0 | 0 | 1 | 0 | ○ | ○ | ○ | ● | | 9 |
| 0100 | 0 | 0 | 0 | 0 | 1 | ○ | ○ | ○ | ○ | ● | 16 |
| 0101 | 0 | 0 | 0 | 0 | 0 | ○ | ○ | ○ | ○ | ○ | 27 |

BLACK CIRCLE : SELECTIVE ERASE DISCHARGE
WHITE CIRCLE : LIGHT EMISSION

FIG. 16

SELECTIVE ERASE

| Ds | HD | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| 000000~000011 | 1 | 0 | 0 | 0 | 0 | 0 | 0 | 0 | 0 | 0 | 0 | 0 | 0 | 0 |
| 000100~000111 | 0 | 1 | 0 | 0 | 0 | 0 | 0 | 0 | 0 | 0 | 0 | 0 | 0 | 0 |
| 001000~001011 | 0 | 0 | 1 | 0 | 0 | 0 | 0 | 0 | 0 | 0 | 0 | 0 | 0 | 0 |
| 001100~001111 | 0 | 0 | 0 | 1 | 0 | 0 | 0 | 0 | 0 | 0 | 0 | 0 | 0 | 0 |
| 010000~010011 | 0 | 0 | 0 | 0 | 1 | 0 | 0 | 0 | 0 | 0 | 0 | 0 | 0 | 0 |
| 010100~010111 | 0 | 0 | 0 | 0 | 0 | 1 | 0 | 0 | 0 | 0 | 0 | 0 | 0 | 0 |
| 011000~011011 | 0 | 0 | 0 | 0 | 0 | 0 | 1 | 0 | 0 | 0 | 0 | 0 | 0 | 0 |
| 011100~011111 | 0 | 0 | 0 | 0 | 0 | 0 | 0 | 1 | 0 | 0 | 0 | 0 | 0 | 0 |
| 100000~100011 | 0 | 0 | 0 | 0 | 0 | 0 | 0 | 0 | 1 | 0 | 0 | 0 | 0 | 0 |
| 100100~100111 | 0 | 0 | 0 | 0 | 0 | 0 | 0 | 0 | 0 | 1 | 0 | 0 | 0 | 0 |
| 101000~101011 | 0 | 0 | 0 | 0 | 0 | 0 | 0 | 0 | 0 | 0 | 1 | 0 | 0 | 0 |
| 101100~101111 | 0 | 0 | 0 | 0 | 0 | 0 | 0 | 0 | 0 | 0 | 0 | 1 | 0 | 0 |
| 110000~110011 | 0 | 0 | 0 | 0 | 0 | 0 | 0 | 0 | 0 | 0 | 0 | 0 | 1 | 0 |
| 110100~110111 | 0 | 0 | 0 | 0 | 0 | 0 | 0 | 0 | 0 | 0 | 0 | 0 | 0 | 1 |
| 111000 | 0 | 0 | 0 | 0 | 0 | 0 | 0 | 0 | 0 | 0 | 0 | 0 | 0 | 0 |

DR = "11"
(0-255)

DR = "10"
(55-182)

DR = "01"
(91-146)

FIG. 25

SELECTIVE ERASE

| Ds | HD | | | | | | | | | | | | | | LIGHT EMISSION DRIVE PATTERN IN ONE FIELD | | | | | | | | | | | | | | BRIGHTNESS | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | (a) | (b) | (c) |
| 0000 | 1 | 0 | 0 | 0 | 0 | 0 | 0 | 0 | 0 | 0 | 0 | 0 | 0 | 0 | ● | | | | | | | | | | | | | | 0 | 0 | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 | 9 | 27 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 | 13 | 29 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 | 17 | 32 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 16 | 22 | 35 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 | 29 | 39 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 | 35 | 42 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 | 43 | 46 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 | 52 | 49 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 | 61 | 53 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 | 72 | 57 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 151 | 83 | 61 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 | 95 | 66 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 | 108 | 70 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 | 122 | 75 |

FIG. 26

SELECTIVE ERASE

| Ds | HD | | | | | | | | | | | | | | LIGHT EMISSION DRIVE PATTERN IN ONE FIELD | | | | | | | | | | | | | | BRIGHTNESS | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | (a) | (b) | (c) |
| 0000 | 1 | 1 | * | * | * | * | * | * | * | * | * | * | * | * | ● | ● | △ | △ | △ | △ | △ | △ | △ | △ | △ | △ | △ | △ | 0 | 0 | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 | 9 | 27 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 | 13 | 29 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 | 17 | 32 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 16 | 22 | 35 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 | 29 | 39 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 | 35 | 42 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 | 43 | 46 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 | 52 | 49 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 | 61 | 53 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 | 72 | 57 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 151 | 83 | 61 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 | 95 | 66 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 | 108 | 70 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 | 122 | 75 |

FIG. 29

| Ds | HD | | | | LIGHT EMISSION DRIVE PATTERN | | | | BRIGHT-NESS |
|---|---|---|---|---|---|---|---|---|---|
| | 1 | 2 | 3 | 4 | SF 1 | SF 2 | SF 3 | SF 4 | (c) |
| 0000 | 1 | 0 | 0 | 0 | ● | | | | 0 |
| 0001 | 0 | 1 | 0 | 0 | ○ | ● | | | 27 |
| 0010 | 0 | 0 | 1 | 0 | ○ | ○ | ● | | 40 |
| 0011 | 0 | 0 | 0 | 1 | ○ | ○ | ○ | ● | 56 |
| 0100 | 0 | 0 | 0 | 0 | ○ | ○ | ○ | ○ | 75 |

BLACK CIRCLE : SELECTIVE ERASE DISCHARGE
WHITE CIRCLE : LIGHT EMISSION

FIG. 31

SELECTIVE ERASE

| Ds | HD | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| 000000~000011 | 1 | 0 | 0 | 0 | 0 | 0 | 0 | 0 | 0 | 0 | 0 | 0 | 0 | 0 |
| 000100~000111 | 0 | 1 | 0 | 0 | 0 | 0 | 0 | 0 | 0 | 0 | 0 | 0 | 0 | 0 |
| 001000~001011 | 0 | 0 | 1 | 0 | 0 | 0 | 0 | 0 | 0 | 0 | 0 | 0 | 0 | 0 |
| 001100~001111 | 0 | 0 | 0 | 1 | 0 | 0 | 0 | 0 | 0 | 0 | 0 | 0 | 0 | 0 |
| 010000~010011 | 0 | 0 | 0 | 0 | 1 | 0 | 0 | 0 | 0 | 0 | 0 | 0 | 0 | 0 |
| 010100~010111 | 0 | 0 | 0 | 0 | 0 | 1 | 0 | 0 | 0 | 0 | 0 | 0 | 0 | 0 |
| 011000~011011 | 0 | 0 | 0 | 0 | 0 | 0 | 1 | 0 | 0 | 0 | 0 | 0 | 0 | 0 |
| 011100~011111 | 0 | 0 | 0 | 0 | 0 | 0 | 0 | 1 | 0 | 0 | 0 | 0 | 0 | 0 |
| 100000~100011 | 0 | 0 | 0 | 0 | 0 | 0 | 0 | 0 | 1 | 0 | 0 | 0 | 0 | 0 |
| 100100~100111 | 0 | 0 | 0 | 0 | 0 | 0 | 0 | 0 | 0 | 1 | 0 | 0 | 0 | 0 |
| 101000~101011 | 0 | 0 | 0 | 0 | 0 | 0 | 0 | 0 | 0 | 0 | 1 | 0 | 0 | 0 |
| 101100~101111 | 0 | 0 | 0 | 0 | 0 | 0 | 0 | 0 | 0 | 0 | 0 | 1 | 0 | 0 |
| 110000~110011 | 0 | 0 | 0 | 0 | 0 | 0 | 0 | 0 | 0 | 0 | 0 | 0 | 1 | 0 |
| 110100~110111 | 0 | 0 | 0 | 0 | 0 | 0 | 0 | 0 | 0 | 0 | 0 | 0 | 0 | 1 |
| 111000 | 0 | 0 | 0 | 0 | 0 | 0 | 0 | 0 | 0 | 0 | 0 | 0 | 0 | 0 |

FIG. 32A PL = "11"

FIG. 32B PL = "10"

FIG. 32C PL = "01"

FIG. 34

SELECTIVE WRITE

| Ds | HD 1 | 2 | 3 | 4 | 5 | 6 | 7 | 8 | 9 | 10 | 11 | 12 | 13 | 14 | LIGHT EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | BRIGHTNESS (a) | (b) | (c) |
|---|---|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | 0 | 0 | 0 |
| 0001 | 0 | 0 | 0 | 0 | 0 | 0 | 0 | 0 | 0 | 0 | 0 | 0 | 0 | 1 | | | | | | | | | | | | | | ● | 1 | 0 | 0 |
| 0010 | 0 | 0 | 0 | 0 | 0 | 0 | 0 | 0 | 0 | 0 | 0 | 0 | 1 | 0 | | | | | | | | | | | | | ● | ○ | 4 | 2 | 0 |
| 0011 | 0 | 0 | 0 | 0 | 0 | 0 | 0 | 0 | 0 | 0 | 0 | 1 | 0 | 0 | | | | | | | | | | | | ● | ○ | ○ | 9 | 4 | 1 |
| 0100 | 0 | 0 | 0 | 0 | 0 | 0 | 0 | 0 | 0 | 0 | 1 | 0 | 0 | 0 | | | | | | | | | | | ● | ○ | ○ | ○ | 16 | 8 | 2 |
| 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 27 | 13 | 3 |
| 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 40 | 19 | 4 |
| 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 56 | 27 | 6 |
| 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 75 | 36 | 8 |
| 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 97 | 46 | 10 |
| 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 122 | 58 | 13 |
| 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 151 | 72 | 16 |
| 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 182 | 87 | 19 |
| 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 217 | 104 | 23 |
| 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 256 | 122 | 27 |

BLACK CIRCLE : SELECTIVE WRITE DISCHARGE
WHITE CIRCLE : LIGHT EMISSION

FIG. 35

SELECTIVE WRITE

| Ds | HD | | | | | | | | | | | | | | LIGHT EMISSION DRIVE PATTERN IN ONE FIELD | | | | | | | | | | | | | | BRIGHTNESS | | |
|---|---|---|---|---|---|---|---|---|---|---|---|---|---|---|---|---|---|---|---|---|---|---|---|---|---|---|---|---|---|---|---|
| | 14 | 13 | 12 | 11 | 10 | 9 | 8 | 7 | 6 | 5 | 4 | 3 | 2 | 1 | SF 14 | SF 13 | SF 12 | SF 11 | SF 10 | SF 9 | SF 8 | SF 7 | SF 6 | SF 5 | SF 4 | SF 3 | SF 2 | SF 1 | (a) | (b) | (c) |
| 0000 | 0 | 0 | 0 | 0 | 0 | 0 | 0 | 0 | 0 | 0 | 0 | 0 | 0 | 0 | | | | | | | | | | | | | | | 0 | 0 | 0 |
| 0001 | 0 | 0 | 0 | 0 | 0 | 0 | 0 | 0 | 0 | 0 | 0 | 0 | 0 | 1 | | | | | | | | | | | | | | ● | 1 | 0 | 0 |
| 0010 | 0 | 0 | 0 | 0 | 0 | 0 | 0 | 0 | 0 | 0 | 0 | 0 | 1 | 1 | | | | | | | | | | | | | ● | ● | 4 | 2 | 0 |
| 0011 | 0 | 0 | 0 | 0 | 0 | 0 | 0 | 0 | 0 | 0 | 0 | 1 | 1 | * | | | | | | | | | | | | ● | ● | ○ | 9 | 4 | 1 |
| 0100 | 0 | 0 | 0 | 0 | 0 | 0 | 0 | 0 | 0 | 0 | 1 | 1 | * | * | | | | | | | | | | | ● | ● | ○ | ○ | 16 | 8 | 2 |
| 0101 | 0 | 0 | 0 | 0 | 0 | 0 | 0 | 0 | 0 | 1 | 1 | * | * | * | | | | | | | | | | ● | ● | ○ | ○ | ○ | 27 | 13 | 3 |
| 0110 | 0 | 0 | 0 | 0 | 0 | 0 | 0 | 0 | 1 | 1 | * | * | * | * | | | | | | | | | ● | ● | ○ | ○ | ○ | ○ | 40 | 19 | 4 |
| 0111 | 0 | 0 | 0 | 0 | 0 | 0 | 0 | 1 | 1 | * | * | * | * | * | | | | | | | | ● | ● | ○ | ○ | ○ | ○ | ○ | 56 | 27 | 6 |
| 1000 | 0 | 0 | 0 | 0 | 0 | 0 | 1 | 1 | * | * | * | * | * | * | | | | | | | ● | ● | ○ | ○ | ○ | ○ | ○ | ○ | 75 | 36 | 8 |
| 1001 | 0 | 0 | 0 | 0 | 0 | 1 | 1 | * | * | * | * | * | * | * | | | | | | ● | ● | ○ | ○ | ○ | ○ | ○ | ○ | ○ | 97 | 46 | 10 |
| 1010 | 0 | 0 | 0 | 0 | 1 | 1 | * | * | * | * | * | * | * | * | | | | | ● | ● | ○ | ○ | ○ | ○ | ○ | ○ | ○ | ○ | 122 | 58 | 13 |
| 1011 | 0 | 0 | 0 | 1 | 1 | * | * | * | * | * | * | * | * | * | | | | ● | ● | ○ | ○ | ○ | ○ | ○ | ○ | ○ | ○ | ○ | 151 | 72 | 16 |
| 1100 | 0 | 0 | 1 | 1 | * | * | * | * | * | * | * | * | * | * | | | ● | ● | ○ | ○ | ○ | ○ | ○ | ○ | ○ | ○ | ○ | ○ | 182 | 87 | 19 |
| 1101 | 0 | 1 | 1 | * | * | * | * | * | * | * | * | * | * | * | | ● | ● | ○ | ○ | ○ | ○ | ○ | ○ | ○ | ○ | ○ | ○ | ○ | 217 | 104 | 23 |
| 1110 | 1 | 1 | * | * | * | * | * | * | * | * | * | * | * | * | ● | ● | ○ | ○ | ○ | ○ | ○ | ○ | ○ | ○ | ○ | ○ | ○ | ○ | 256 | 122 | 27 |

BLACK CIRCLE : SELECTIVE WRITE DISCHARGE
WHITE CIRCLE : LIGHT EMISSION

METHOD FOR DRIVING DISPLAY PANEL

BACKGROUND OF THE INVENTION

1. Field of the Invention

The present invention relates to a method for driving a display panel of a matrix display scheme.

2. Description of Related Art

Recently, plasma display panels (hereinafter referred to as "PDP") and electroluminescent display panels (hereinafter referred to as "ELDP") have been brought into practical use as thin flat display panels of the matrix display scheme. Since the light-emitting elements of these PDP and ELDP have only two "light-emitting" and "non-light-emitting" states, halftone drive is effected using a sub-field method in order to obtain halftone brightness corresponding to an input video signal.

By the sub-field method, an input video signal is converted into N-bit pixel data for each pixel and the display period of one field is divided into N sub-fields corresponding to each of the N-bit bit digits. A number (frequency) of light emissions corresponding to each of the bit digits of the aforementioned pixel data, is assigned to each of the N sub-fields respectively. In cases where one bit digit of the aforementioned N bits has, for example, a logic level of "1", light emission is executed for the number (frequency) assigned as mentioned above in the sub-field corresponding to the bit digit. On the other hand, in cases where the aforementioned one bit digit has a logic level "0", no light emission is effected in the sub-field corresponding to the bit digit. According to such a drive method, levels of halftone brightness corresponding to the input video signal are expressed by the sum of the number of times of light emissions executed in all sub-fields within the display period of one field.

OBJECCT AND SUMMARY OF THE INVENTION

An object of the present invention is to provide a drive method by which a good reproduction of halftone brightness levels can be possible with low power consumption when the aforementioned sub-field method is used to drive levels of halftone in a display panel employing the matrix display scheme.

The method for driving a display panel according to the present invention is to drive a display panel, in which a plurality of pixel cells are formed in accordance with a video signal. The unit display period of said video signal is divided into a plurality of divided display periods. In each of said divided display periods, the pixel data write process in which each of said pixel cells is set to either a light-emitting cell or a non-light-emitting cell in accordance with pixel data corresponding to said video signal is carried out. In addition, in each of said divided display periods, the light emission sustain process in which only said light-emitting cell is allowed to emit light for a number of light emissions corresponding to a weight assigned to each of said divided display periods is carried out. In accordance with the brightness level of said video signal, said number of light emissions that are to be assigned to each of said divided display periods is changed.

BRIEF DESCRIPTION OF THE DRAWINGS

FIG. 7 is a view showing an example of a data conversion table of a second data conversion circuit 34;

FIG. 10 is a view showing a data conversion table of the second data conversion circuit 34 and a light emission drive pattern when a drive is effected in accordance with the light emission drive format shown in FIG. 8A to FIG. 8C in accordance with drive pixel data HD;

FIG. 11 is a view showing another example of the data conversion table and the light emission drive pattern, which are shown in FIG. 10;

FIG. 14 is a view showing the data conversion table to be used in the second conversion circuit 34 and the light emission drive pattern when a drive is effected in accordance with the light emission drive format shown in FIG. 12;

FIG. 16 is a view showing the data conversion table used in the second conversion circuit 34 when the number of compressed bits provided by the multi-level gray scale processing circuit 33 is reduced from four bits to 2 bits;

FIG. 25 is a view showing the data conversion table and the light emission drive pattern of a second data conversion circuit 34 of the plasma display device shown in FIG. 17;

FIG. 26 is a view showing another example of the data conversion table and the light emission drive pattern, which are shown in FIG. 25;

FIG. 29 is a view showing the data conversion table and the light emission drive pattern, which are used in the second data conversion circuit 34 when a drive is carried out in accordance with the light emission drive format shown in FIG. 27;

FIG. 31 is a view showing the data conversion table and the light emission drive pattern to be used in the second data conversion circuit 34 when the number of compressed bits provided by the multi-level gray scale processing circuit 33 is reduced from four bits to 2 bits;

FIG. 34 is a view showing the data conversion table and the light emission drive pattern, which are used in the second data conversion circuit 34 when a drive is carried out by employing a selective write address method;

FIG. 35 is a view showing another example of the data conversion table and the light emission drive pattern, which are used in the second data conversion circuit 34 when a drive is carried out by employing a selective write address method.

DETAILED DESCRIPTION OF THE PREFERRED EMBODIMENTS

The embodiments of the present invention will be explained below with reference to the drawings.

Figure 1:
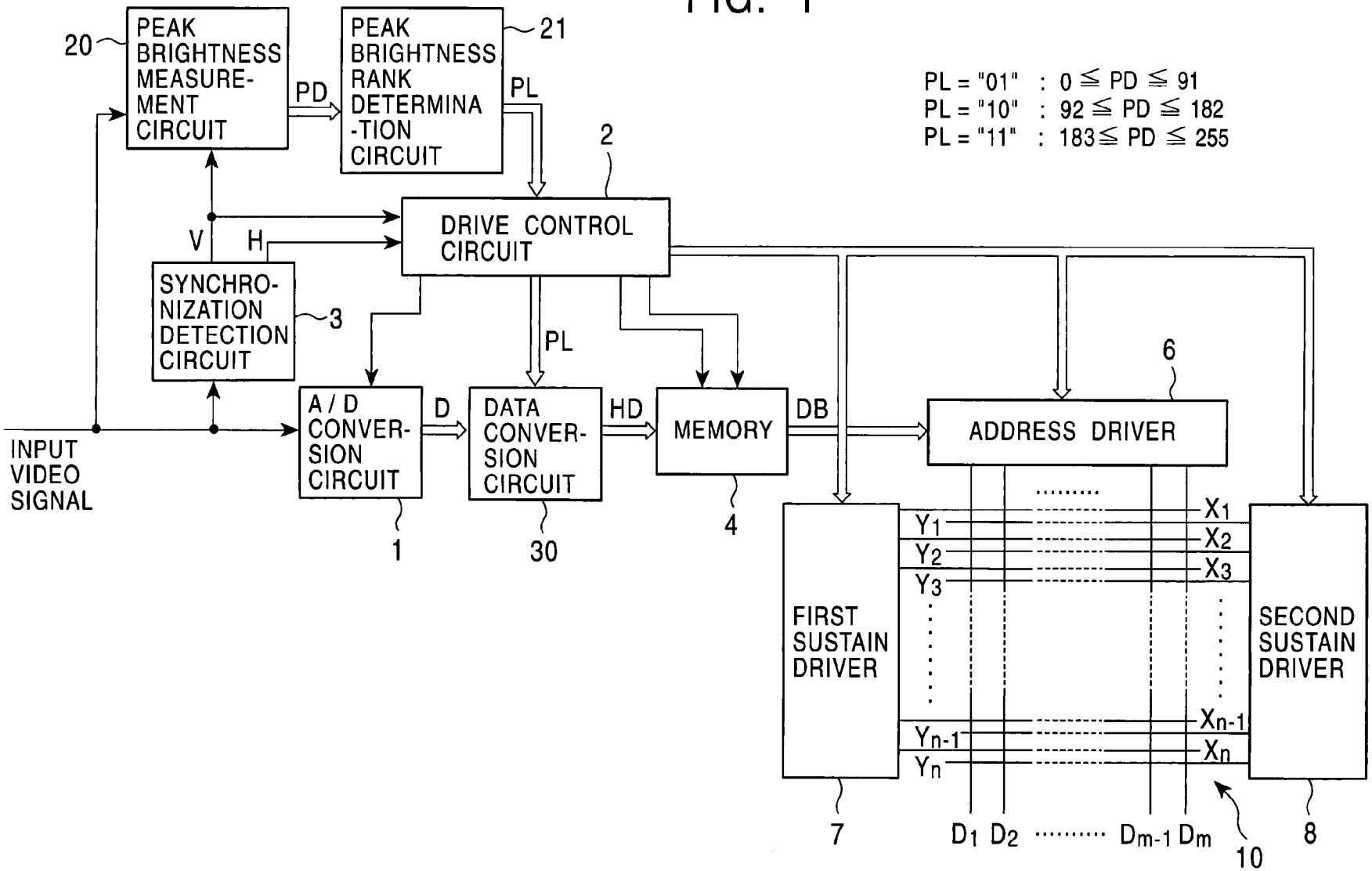
FIG. 1 is a schematic view showing the configuration of a plasma display device for driving a plasma display panel in accordance with the drive method according to the present invention.

FIG. 1 is a schematic view showing the configuration of a plasma display device for performing image display by driving a plasma display panel, which serves as a display panel employing the matrix display scheme, in accordance with the drive method according to the present invention.

As shown in FIG. 1, such a plasma display device comprises a PDP 10 as a plasma display panel and a drive portion for driving the PDP 10.

The PDP 10 comprises m electrode columns $D_1$ through $D_m$ serving as address electrodes, and n electrode rows $X_1$ through $X_n$ and n electrode rows $Y_1$ through $Y_n$, which are arranged to intersect these electrode columns, respectively. A pair of an electrode row X and an electrode row Y forms an electrode row corresponding to one line of the PDP 10. The electrode columns D and electrode rows X, Y are coated with a dielectric layer exposed to a discharge space, and a discharge cell corresponding to one pixel is so configured as to be formed at an intersection of each pair of electrode rows and an electrode column.

On the other hand, when a vertical synchronization signal is detected in an analog input video signal that has been subjected to γ correction processing beforehand, a synchronization detector circuit 3 of a drive portion generates a vertical synchronization detection signal V, which is in turn supplied to a drive control circuit 2 and a peak brightness measurement circuit 20, respectively. In addition, when a horizontal synchronization signal is detected in such an input video signal, the synchronization detector circuit 3 generates a horizontal synchronization detection signal H, which is in turn supplied to the drive control circuit 2.

The A/D converter 1 samples the aforementioned input video signal in accordance with a clock signal supplied from the drive control circuit 2 and converts the signal into pixel data D for each pixel, which is in turn supplied to a data conversion circuit 30. Furthermore, such pixel data D is 8-bit data by which the brightness of 256 levels of halftone, comprising "0"–"255", can be expressed.

At every one field of input video signal defined by the aforementioned vertical synchronization detection signal V, the peak brightness measurement circuit 20 measures the maximum brightness level in the one field of input video signal and supplies the peak brightness data PD showing the brightness level to a peak brightness rank determination circuit 21. The peak brightness rank determination circuit 21 determines which range of "0"–"91", "92"–"182", or "183"–"255" the peak brightness level shown by the aforementioned peak brightness data PD lies in. Here, if it is determined that such peak brightness level lies within the range of "0"–"91", the peak brightness rank determination circuit 21 supplies the peak brightness rank signal PL of "01" showing that the level belongs to the low brightness rank to the drive control circuit 2 and the data conversion circuit 30, respectively. Moreover, if it is determined that the peak brightness level shown by the aforementioned peak brightness data PD lies within the range of "92"–"182", the peak brightness rank determination circuit 21 supplies the peak brightness rank signal PL of "10" showing that the level belongs to the middle brightness rank to the drive control circuit 2 and the data conversion circuit 30, respectively. Moreover, if it is determined that the peak brightness level shown by the aforementioned peak brightness data PD lies within the range of "183"–"255", the peak brightness rank determination circuit 21 supplies the peak brightness rank signal PL of "11" showing that the level belongs to the high brightness rank to the drive control circuit 2 and the data conversion circuit 30, respectively.

Figure 2:
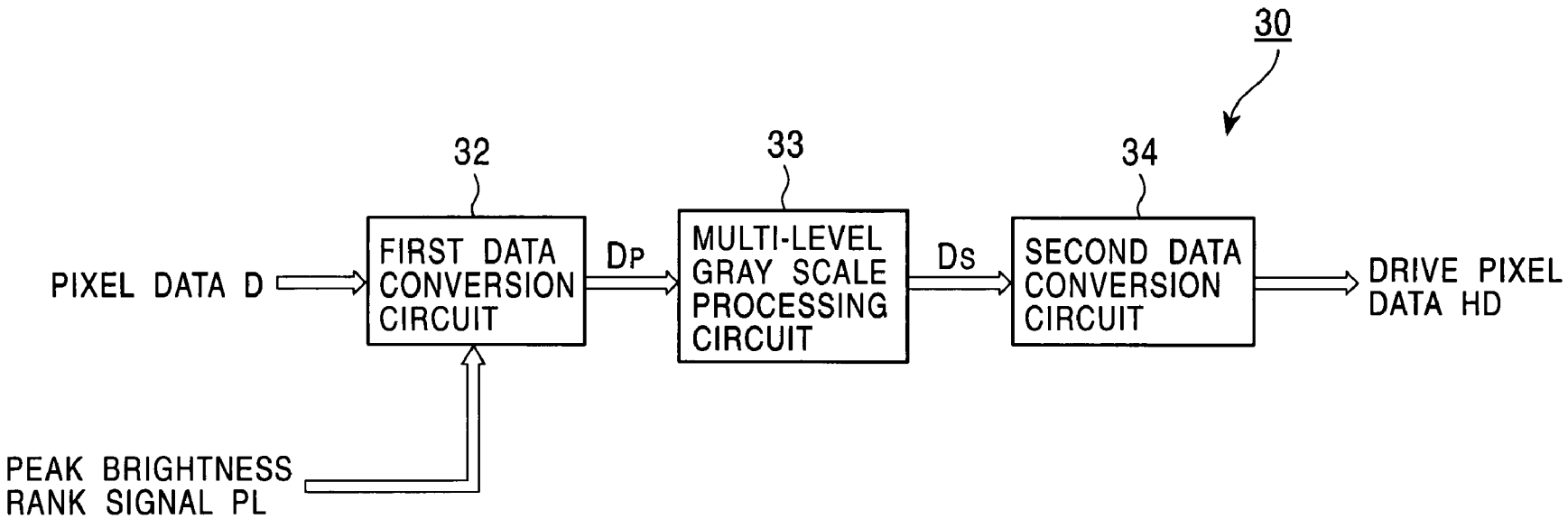
FIG. 2 is a view showing the internal configuration of a data conversion circuit 30.

FIG. 2 is a view showing the internal configuration of such a data conversion circuit 30.

Referring to FIG. 2, a first data conversion circuit 32 converts the value of data of the aforementioned pixel data D that can express 256 levels of halftone of 8 bits of "0"–"255" into adjusted pixel data Dp having the range of "0"–"224", and supplies the adjusted pixel data Dp to a multi-level gray scale processing circuit 33. Furthermore, the conversion characteristics of such first data conversion circuit 32 from the pixel data D to the adjusted pixel data Dp corresponds to the aforementioned peak brightness rank signal PL.

Figure 3:
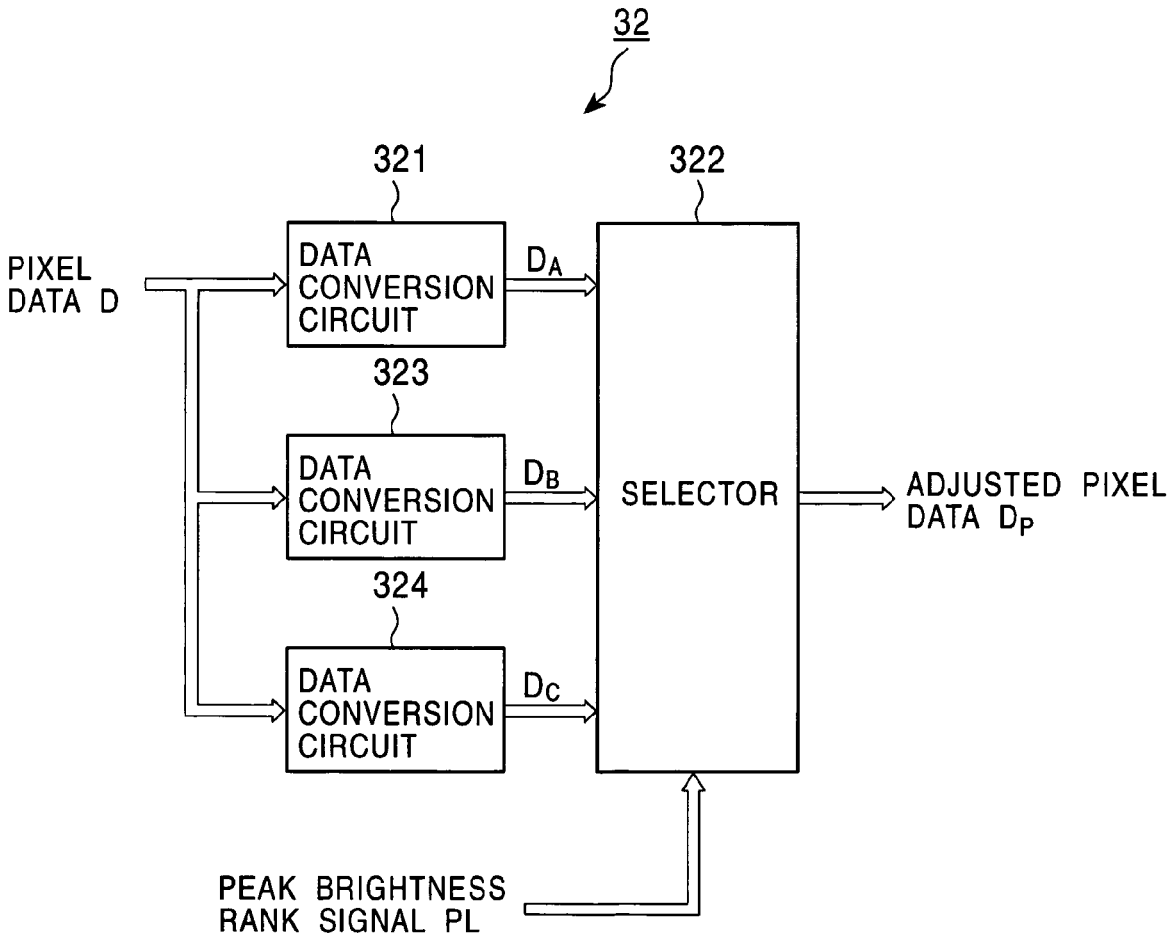
FIG. 3 is a view showing the internal configuration of a first data conversion circuit 32.

FIG. 3 shows the internal configuration of such first data conversion circuit 32.

Figure 4:
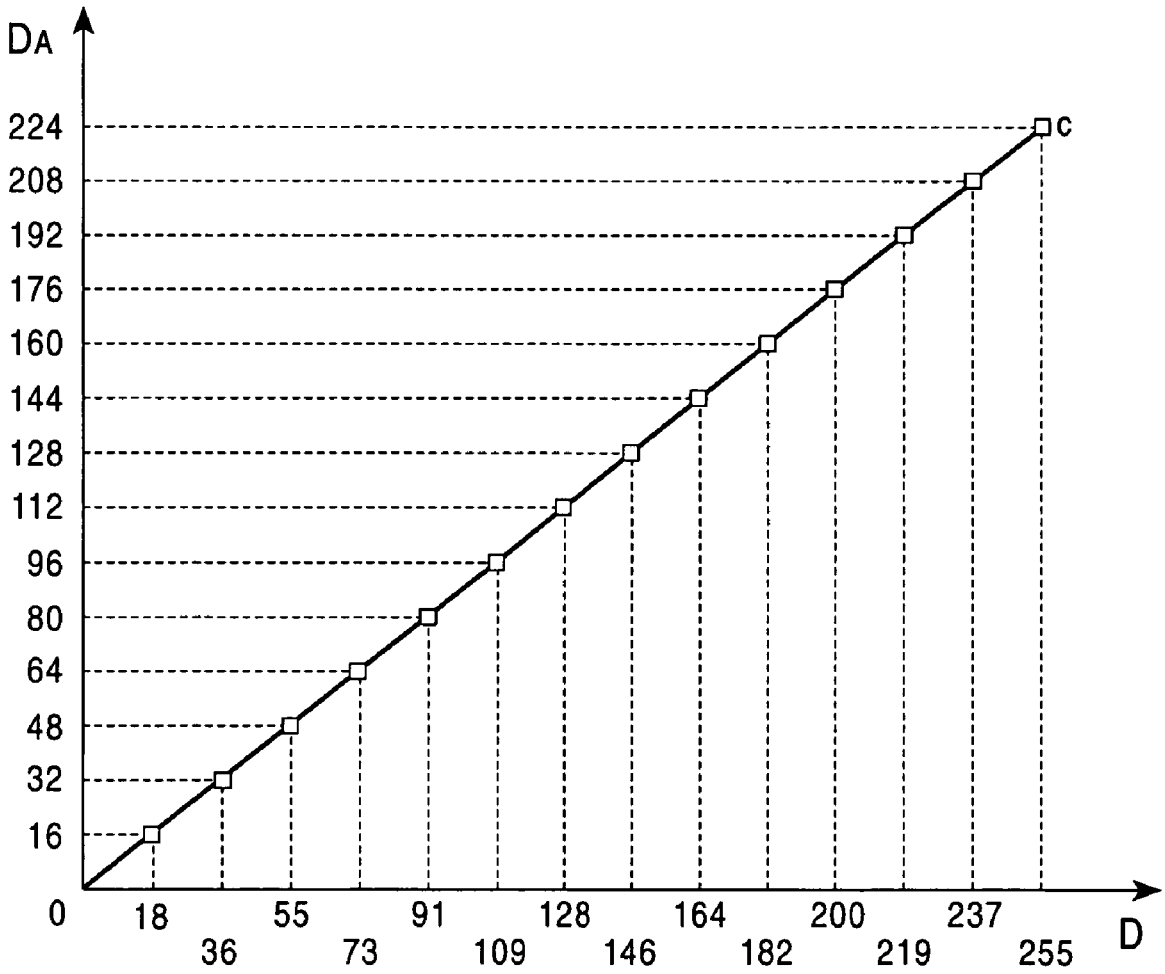
FIG. 4 is a view showing the conversion characteristicss of a data conversion circuit 321.
Figure 5:
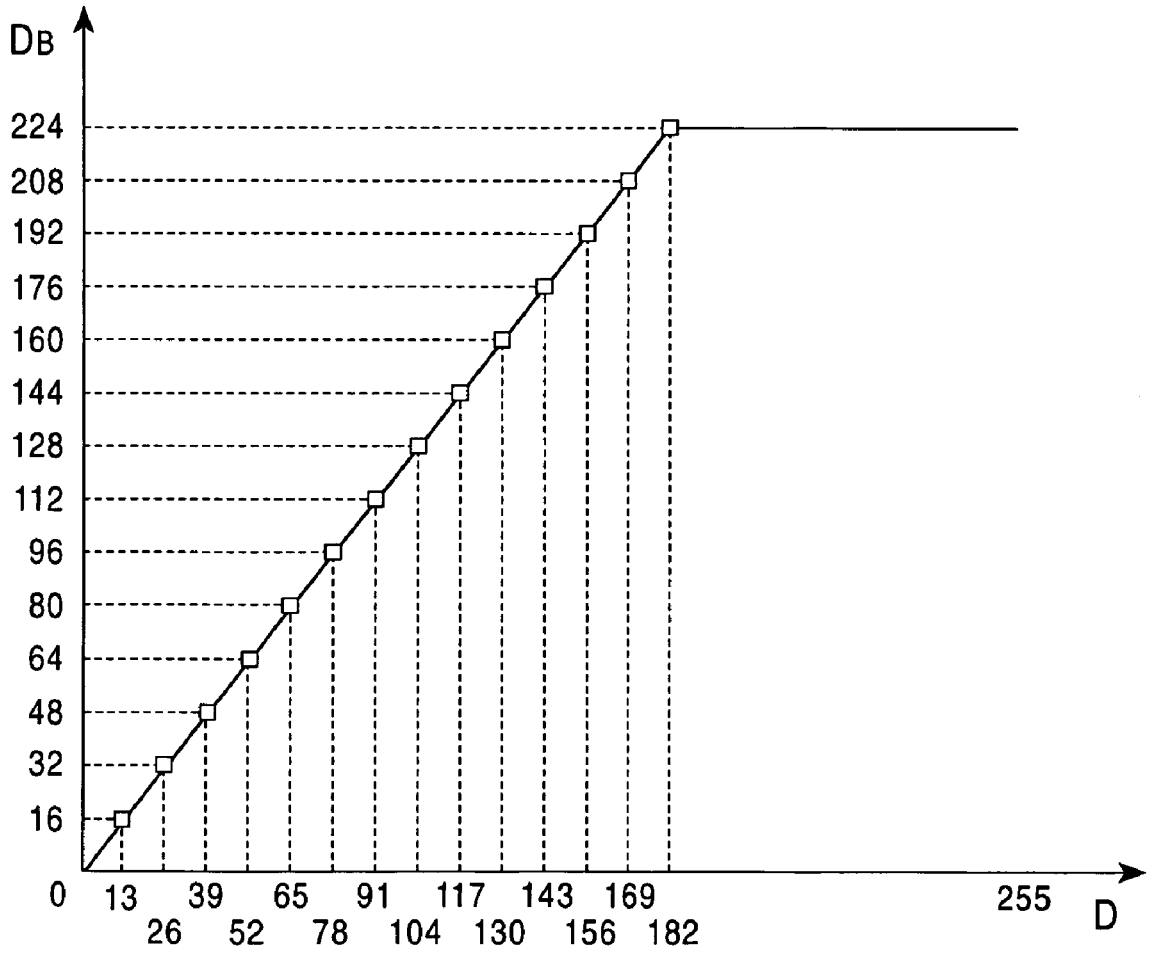
FIG. 5 is a view showing the conversion characteristicss of a data conversion circuit 323.
Figure 6:
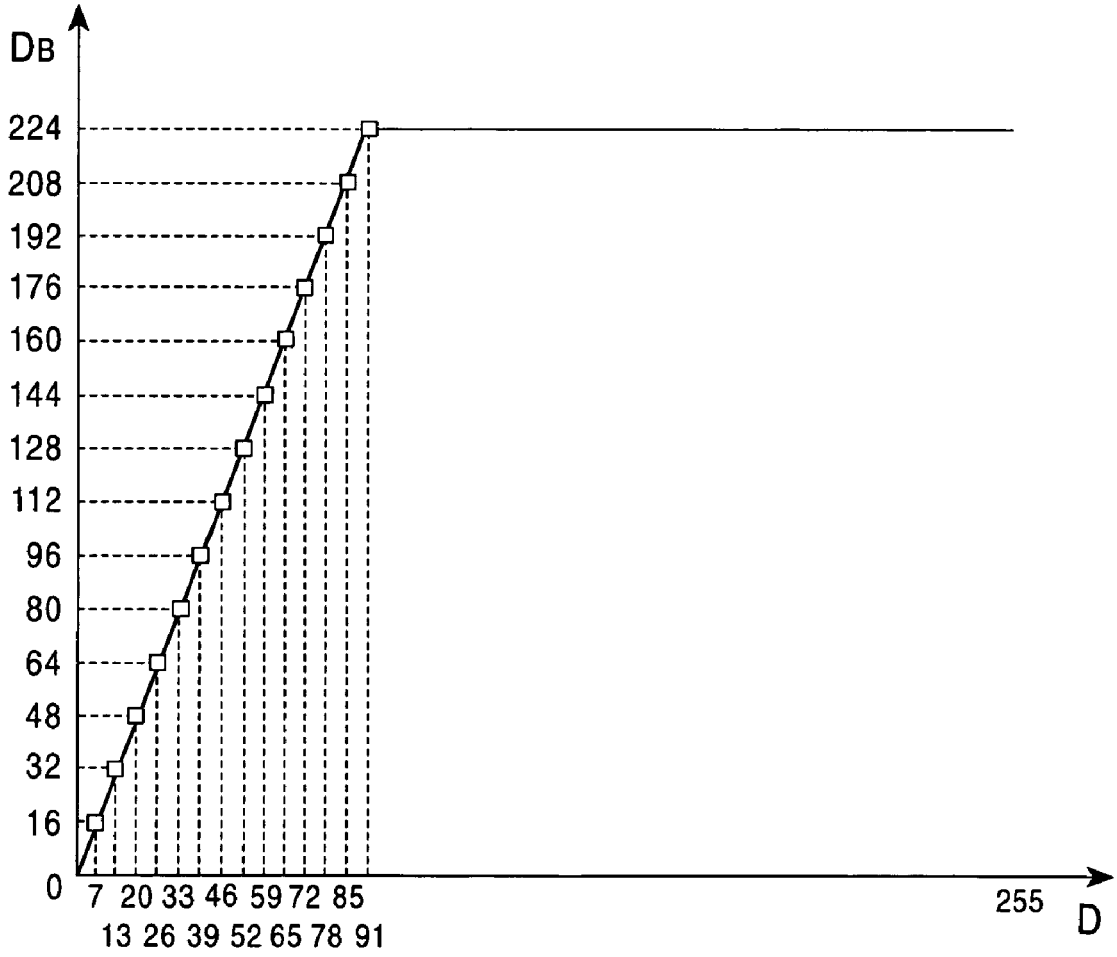
FIG. 6 is a view showing the conversion characteristicss of a data conversion circuit 324.

In FIG. 3, a data conversion circuit 321 converts the aforementioned pixel data D into pixel data $D_A$ having the range of brightness of "0"–"224" of 8 bits in accordance with the conversion characteristics as shown in FIG. 4, and then supplies the pixel data $D_A$ to a selector 322. A data conversion circuit 323 converts the aforementioned pixel data D into pixel data $D_B$ having the range of brightness of "0"–"224" of 8 bits in accordance with the conversion characteristics as shown in FIG. 5, and then supplies the pixel data $D_B$ to the selector 322. A data conversion circuit 324 converts the aforementioned pixel data D into pixel data $D_C$ having the range of brightness of "0"–"224" of 8 bits in accordance with the conversion characteristics as shown in FIG. 6, and then supplies the pixel data $D_C$ to the selector 322. The selector 322 selects one of the aforementioned pixel data $D_A$, $D_B$, and $D_C$, which corresponds to the aforementioned peak brightness rank signal PL, and then outputs the one as the adjusted pixel data Dp. That is, in a case where the aforementioned peak brightness rank signal PL is equal to "01", that is, if the peak brightness rank signal PL belongs to the low brightness rank, the selector 322 uniquely selects the pixel data $D_C$ among the aforementioned pixel data $D_A$, $D_B$, $D_C$, and then outputs the pixel data $D_C$ as the adjusted pixel data Dp. Moreover, in a case where the aforementioned peak brightness rank signal PL is equal to "10", that is, if the peak brightness rank signal PL belongs to the middle brightness rank, the selector 322 uniquely selects the pixel data $D_B$, and then outputs the pixel data $D_B$ as the adjusted pixel data Dp. Moreover, in a case where the aforementioned peak brightness rank signal PL is equal to "11", that is, if the peak brightness rank signal PL belongs to the high brightness rank, the selector 322 uniquely selects the pixel data $D_A$, and then outputs the pixel data $D_A$ as the adjusted pixel data Dp.

The multi-level gray scale processing circuit 33 of FIG. 2 performs error diffusion processing and dither processing on the 8-bit pixel data Dp supplied from the aforementioned multi-level gray scale correction circuit 32, thereby determining multi-level gray scale pixel data Ds that is provided with the number of the bits thereof compressed to 4 bits while maintaining the number of visual brightness expression levels of halftone to substantially 256 levels of halftone.

First, the aforementioned error diffusion processing is adapted to separate the upper 6 bits from the pixel data Dp as display data and the remaining lower 2 bits as error data, respectively, and the error data which is determined based on the pixel data Dp corresponding to respective peripheral pixels and to which weights are assigned respectively is summed up to be reflected upon the aforementioned display data. Such operation allows for expressing apparently the lower 2 bits of the brightness of an original pixel with the aforementioned peripheral pixels. Therefore, this makes it possible to express the brightness levels of halftone equivalent to that provided by the aforementioned 8 bits of the pixel data by means of display data having the number of bits less than 8 bits, that is, with 6 bits of display data.

Next, dither processing is performed on the 6-bit error diffusion processing pixel data obtained by such error diffusion processing, thereby generating multi-level gray scale pixel data Ds with the number of bits thereof reduced to 4 bits while maintaining the brightness levels of halftone equivalent to such error diffusion processing pixel data. Furthermore, dither processing is to express an intermediate level of display with a plurality of adjacent pixels. For example, consider a case where a halftone display equivalent to 8 bits is effected by using pixel data of the upper 6 bits of the 8-bit pixel data. In this case, four pixels adjacent to one another on the top and bottom and on the right and left of a pixel are taken as one set, and four dither coefficients a–d, which are comprised of coefficient values different from one another, are assigned to be added to respective pixel data corresponding to each of the set of the pixels. According to such dither processing, four pixels are to produce a combination of four different halftone levels of display. Therefore, even if the number of bits of pixel data is 6 bits, the levels of halftone visualized can be made 4 times, that is, the expression of levels of halftone equivalent 8 bits is made possible.

The multi-level gray scale pixel data Ds generated by such multi-level gray scale processing circuit 33 is supplied to a second data conversion circuit 34.

The second data conversion circuit 34 converts such multi-level gray scale pixel data Ds into 14-bit (comprising the first through fourteenth bit) drive pixel data HD, which is to drive one pixel, in accordance with the conversion table as shown in FIG. 7, and then supplies the drive pixel data HD to a memory 4.

The memory 4 writes the aforementioned drive pixel data HD in sequence in accordance with a write signal supplied from the drive control circuit 2. After writing a screenful of data (for n rows and m columns) has been completed in the PDP 10 through such writing action, the memory 4 treats each bit digit of the screenful of drive pixel data $HD_{11\text{-}nm}$ as divided into fourteen drive pixel data bits $DB1_{11\text{-}nm}$–$DB14_{11\text{-}nm}$ as follows. That is, $DB1_{11\text{-}nm}$: the first bit of the drive pixel data $HD_{11\text{-}nm}$ $DB2_{11\text{-}nm}$: the second bit of the drive pixel data $HD_{11\text{-}nm}$ $DB3_{11\text{-}nm}$: the third bit of the drive pixel data $HD_{11\text{-}nm}$ $DB4_{11\text{-}nm}$: the fourth bit of the drive pixel data $HD_{11\text{-}nm}$ $DB5_{11\text{-}nm}$: the fifth bit of the drive pixel data $HD_{11\text{-}nm}$ $DB6_{11\text{-}nm}$: the sixth bit of the drive pixel data $HD_{11\text{-}nm}$ $DB7_{11\text{-}nm}$: the seventh bit of the drive pixel data $HD_{11\text{-}nm}$ $DB8_{11\text{-}nm}$: the eighth bit of the drive pixel data $HD_{11\text{-}nm}$ $DB9_{11\text{-}nm}$: the ninth bit of the drive pixel data $HD_{11\text{-}nm}$ $DB10_{11\text{-}nm}$: the tenth bit of the drive pixel data $HD_{11\text{-}nm}$ $DB11_{11\text{-}nm}$: the eleventh bit of the drive pixel data $HD_{11\text{-}nm}$ $DB12_{11\text{-}nm}$: the twelfth bit of the drive pixel data $HD_{11\text{-}nm}$ $DB13_{11\text{-}nm}$: the thirteenth bit of the drive pixel data $HD_{11\text{-}nm}$ $DB14_{11\text{-}nm}$: the fourteenth bit of the drive pixel data $HD_{11\text{-}nm}$ Then, the memory 4 reads each of $DB1_{11\text{-}nm}$, $DB2_{11\text{-}nm}$, . . . $DB14_{11\text{-}nm}$ in sequence line by line in accordance with a read signal supplied from the drive control circuit 2 and supplies them to an address driver 6.

The drive control circuit 2 generates a clock signal for the aforementioned A/D converter 1, and a write signal and a read signal for the memory 4 in synchronization with the aforementioned horizontal synchronization detection signal H and the vertical synchronization detection signal V.

Moreover, the drive control circuit 2 selects one of the light emission drive formats shown in FIG. 8A–FIG. 8C, which corresponds to the aforementioned peak brightness rank signal PL. In accordance with this format, the drive control circuit 2 supplies various types of timing signals for driving the PDP 10 to the address driver 6, a first sustain driver 7, and a second sustain driver 8, respectively.

Furthermore, each of the light emission drive formats shown in FIG. 8A–FIG. 8C allows the operation described below to be carried out in each of the 14 sub-fields SF1–SF14 into which the display period of one field is divided. That is, in each sub-field, the formats allow for executing the pixel data write process Wc for writing pixel data into each of the discharge cells of the PDP 10 to set the cell to a "light-emitting cell" or "non-light-emitting cell", and the light emission sustain process Ic for allowing only the aforementioned "light-emitting cell" to emit light for the number (periods) shown in FIG. 8A–FIG. 8C to sustain the light emission state. In addition, the formats allow the simultaneous reset process Rc for resetting the wall charge in all discharge cells of the PDP 10 to be executed only in the head sub-field SF1, and the erase process E for erasing simultaneously the wall charge in the all discharge cells to be executed only in the last sub-field SF14.

In order to implement the aforementioned operation in each of the simultaneous reset process Rc, the pixel data write process Wc, the light emission sustain process Ic, and the erase process E, each of the address driver 6, the first sustain driver 7, and the second sustain driver 8 applies each of the various drive pulses to each of the electrode columns $D_1$–$D_m$, the electrode rows $X_1$–$X_n$, and $Y_1$–$Y_n$ of the PDP 10.

Figure 9:
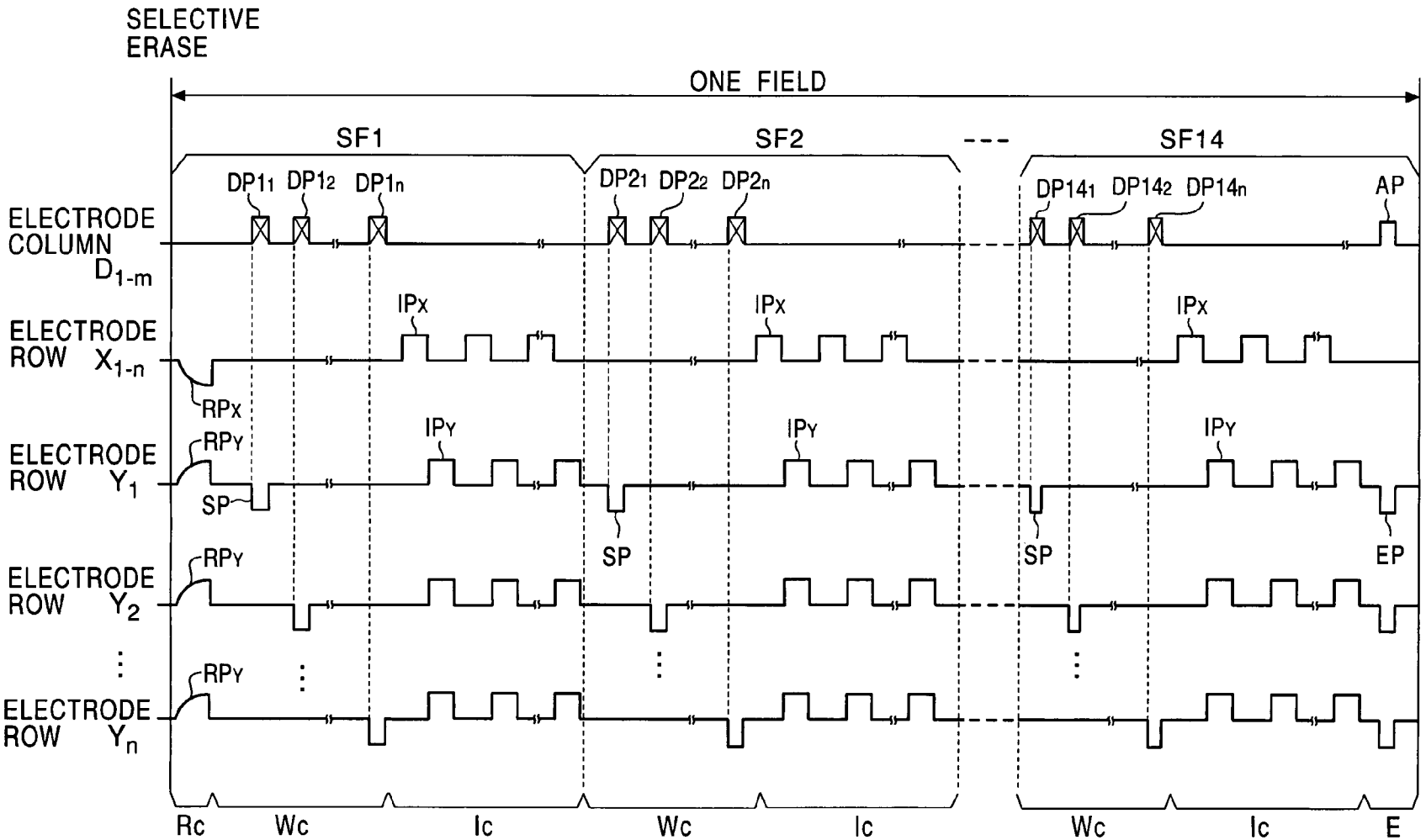
FIG. 9 is a view showing the application timing of various types of drive pulses to be applied to a PDP 10.

FIG. 9 is a view showing an example of the application timing of such drive pulses.

First, in the simultaneous reset process Rc in the head sub-field SF1, the first sustain driver 7 and the second sustain driver 8 apply a reset pulse RPx of negative polarity and a reset pulse RPy of positive polarity to the electrode rows $X_1$–$X_n$ and $Y_1$–$Y_n$ at the same time. The application of these reset pulses RPx and RPy allows reset discharge to be carried out in all discharge cells of the PDP 10, and thus uniform wall charge of a predetermined quantity is built up in respective discharge cells. That is, this allows all discharge cells of the PDP 10 to be once reset to "light-emitting cells".

Next, in the pixel data write process Wc of each sub-field, the address driver 6 generates pixel data pulses that have a voltage corresponding to the logic level of the drive pixel data bit DB supplied from the aforementioned memory 4 and applies the pixel data pulses to the electrode columns $D_{1\text{-}m}$ line by line in sequence. That is, first, in the pixel data write process Wc of sub-field SF1, a data bit corresponding to the first line, that is, $DB\mathbf{1}_{11\text{-}1m}$ is extracted from the aforementioned drive pixel data bits $DB\mathbf{1}_{11\text{-}nm}$. Then a group of pixel data pulses $DP\mathbf{1}_1$ comprising m pixel data pulses corresponding to each of the logic level of $DB\mathbf{1}_{11\text{-}1m}$ is generated and applied to the electrode columns $D_{1\text{-}m}$. Next, $DB\mathbf{1}_{21\text{-}2m}$ corresponding to the second line is extracted from the drive pixel data bits $DB\mathbf{1}_{11\text{-}nm}$. Then a group of pixel data pulses $DP\mathbf{1}_2$ comprising m pixel data pulses corresponding to each of the logic level of $DB\mathbf{1}_{21\text{-}2m}$ is generated and applied to the electrode columns $D_{1\text{-}m}$. Subsequently, likewise, in the pixel data write process Wc of the sub-field SF1, a group of pixel data pulses $DP\mathbf{1}_3$–$DP\mathbf{1}_n$ is applied in sequence to the electrode columns $D_{1\text{-}m}$ line by line. In the pixel data write process Wc of sub-field SF2, first, a data bit corresponding to the first line, that is, $DB\mathbf{2}_{11\text{-}1m}$ is extracted from the aforementioned drive pixel data bits $DB\mathbf{2}_{11\text{-}nm}$. Then a group of pixel data pulses $DP\mathbf{2}_1$ comprising m pixel data pulses corresponding to each of the logic level of $DB\mathbf{2}_{11\text{-}1m}$ is generated and applied to the electrode columns $D_{1\text{-}m}$. Next, $DB\mathbf{2}_{21\text{-}2m}$ corresponding to the second line is extracted from the drive pixel data bits $DB\mathbf{2}_{11\text{-}nm}$. Then a group of pixel data pulses $DP\mathbf{2}_2$ comprising m pixel data pulses corresponding to each of the logic level of $DB\mathbf{2}_{21\text{-}2m}$ is generated and applied to the electrode columns $D_{1\text{-}m}$. Subsequently, likewise, in the pixel data write process Wc of the sub-field SF2, a group of pixel data pulses $DP\mathbf{2}_3$–$DP\mathbf{2}_n$ is applied in sequence to the electrode columns $D_{1\text{-}m}$ line by line. Subsequently, likewise, in the pixel data write process Wc in each of sub-field SF3–SF14, each of the groups of pixel data pulses $DP\mathbf{3}_{1\text{-}n}$–$DP\mathbf{14}_{1\text{-}n}$ generated based on each of the drive pixel data bits $DB\mathbf{3}_{11\text{-}nm}$–$DB\mathbf{14}_{11\text{-}nm}$ is assigned to each of sub-fields SF3–SF14 and applied to the electrode columns $D_{1\text{-}m}$ by the address driver 6. Furthermore, it is to be understood that the address driver 6 generates high voltage pixel data pulses when the drive pixel data bit DB has a logic level "1", while generating low voltage pixel data pulses (zero volt) when the drive pixel data bit DB has a logic level "0".

Moreover, in the pixel data write process Wc of each sub-field, the second sustain driver 8 generates scan pulses SP of negative polarity as shown in FIG. 9 at the same timing as the application timing of each of the aforementioned groups of pixel data pulses DP and applies the pulses in sequence to the electrode rows $Y_1$ through $Y_n$. At this time, discharge (selective erase discharge) is produced only in the discharge cells located at the intersections of the "rows" to which the scan pulse SP is applied and the "columns" to which a high voltage pixel data pulse is applied, so that the wall charge remaining within the discharge cells are selectively erased. That is, the logic level of each of the first through the fourteenth bits of the drive pixel data HD as shown in FIG. 7 is to determine whether the selective erase discharge should be generated in the pixel data write process Wc of each sub-field SF1–SF14. This selective erase discharge causes the discharge cells that have been reset to the state of a "light-emitting cell" at the aforementioned simultaneous reset process Rc to change to a "non-light-emitting cell". Furthermore, the discharge cells that are formed in the "columns" to which the aforementioned high voltage pixel data pulses have not been applied are provided with no discharge, but are sustained to the state of being reset in the aforementioned simultaneous reset process Rc, that is, to the state of a "light-emitting cell". That is, either a "light-emitting cell" in which sustain discharge is generated in the immediately subsequent light emission sustain process Ic or a "non-light-emitting cell" in which no sustain discharge is generated is selectively set corresponding to the pixel data by the pixel data write process Wc carried out in each sub-field.

Next, in the light emission sustain process Ic of each sub-field, the first sustain driver 7 and the second sustain driver 8 apply sustain pulses $IP_x$ and $IP_y$ of positive polarity alternately as shown in FIG. 9 to the electrode rows $X_1$–$X_n$ and $Y_1$–$Y_n$. Here, the number of the sustain pulses IP that should be applied in the light emission sustain process Ic of each sub-field differs depending on the light emission drive format to be used in accordance with the peak brightness rank signal PL.

That is, in the case where the peak brightness rank signal PL supplied from the peak brightness rank determination circuit 21 is "11" that shows the high brightness rank, a drive is carried out in accordance with the light emission drive format shown in FIG. 8A. Therefore, at this time, the number of sustain pulses IP to be applied in the light emission sustain process Ic of each sub-field is as follows. That is,

SF1: 1,

SF2: 3,

SF3: 5,

SF4: 7,

SF5: 11,

SF6: 13,

SF7: 16,

SF8: 19,

SF9: 22,

SF10: 25,

SF11: 29,

SF12: 31,

SF13: 35, and

SF14: 39.

Moreover, in the case where the peak brightness rank signal PL is "10" that shows the middle brightness rank, a drive is carried out in accordance with the light emission drive format shown in FIG. 8B. Therefore, the number of sustain pulses IP to be applied in the light emission sustain process Ic of each sub-field is as follows. That is,

SF1: 0,

SF2: 2,

SF3: 2,

SF4: 4,

SF5: 5,

SF6: 6,

SF7: 8,

SF8: 9,

SF9: 10,

SF10: 12,

SF11: 14,

SF12: 15,

SF13: 17; and

SF14: 18.

Moreover, in the case where the peak brightness rank signal PL is "01" that shows the low brightness rank, a drive is carried out in accordance with the light emission drive format shown in FIG. 8C. Therefore, the number of sustain pulses IP to be applied in the light emission sustain process Ic of each sub-field is as follows. That is,

SF1: 0,

SF2: 0,

SF3: 0,

SF4: 1,

SF5: 1,

SF6: 1,

SF7: 2,

SF8: 2,

SF9: 2,

SF10: 3,

SF11: 3,

SF12: 3,

SF13: 4, and

SF14: 4.

The application of the sustain pulses IP allows only the discharge cells in which wall charge remains in the aforementioned pixel data write process Wc, that is, the "light-emitting cells" to carry out sustain discharge every time the aforementioned sustain pulses IPx and IPy are applied thereto to sustain the light emission state generated by the discharge for the aforementioned number (periods). At this time, the ratio of the number of sustain discharges that should be carried out in each of the sub-fields SF1–SF14 is an inverse γ ratio and the γ characteristic applied to the pixel data D corresponding to the input video signal is released.

Finally, in the erase process E carried out at the last sub-field SF14, the address driver 6 generates the erase pulse AP as shown in FIG. 9 and then applies the pulse to the electrode columns $D_{1\text{-}m}$. The second sustain driver 8 generates an erase pulse EP and applies the pulse to the electrode rows $Y_1$–$Y_n$ at the same time as the application timing of the erase pulse AP. The simultaneous application of the erase pulses AP and EP allows the erase discharge to be generated in all discharge cells of the PDP 10, so that the wall charge remaining in all discharge cells disappears. That is, the erase discharge causes all discharge cells in the PDP 10 to change to "non-light-emitting cells".

Figure 8:
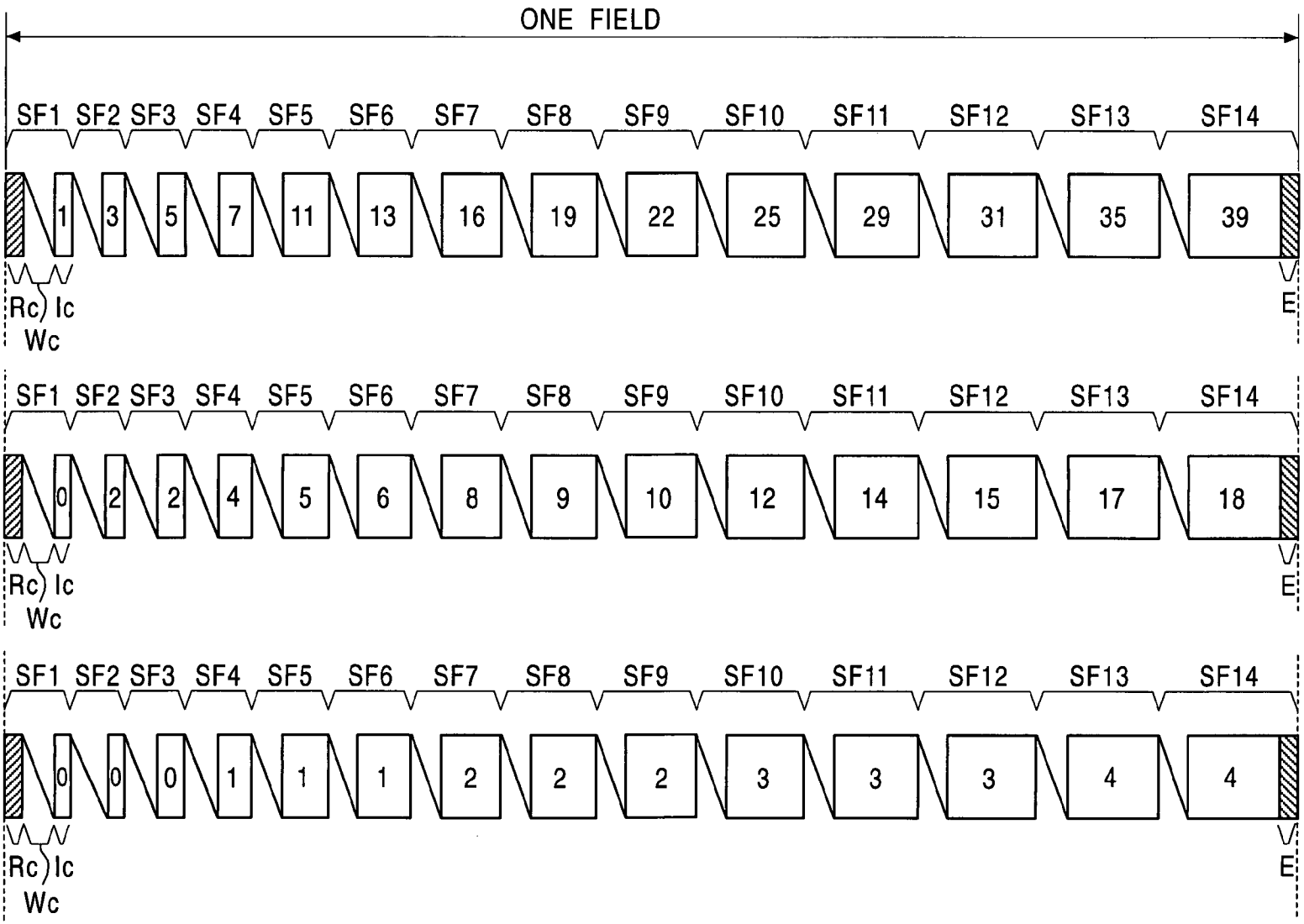
FIG. 8A through FIG. 8C show a light emission drive format in accordance with a drive method according to the present invention.

FIG. 10 shows the data conversion table of the second data conversion circuit 34 as shown in FIG. 7 and the light emission drive pattern to be used when a drive is carried out in accordance with the light emission drive format shown in FIG. 8 based on the drive pixel data HD.

According to such drive pixel data HD, as shown in FIG. 10 by the black circles, the selective erase discharge is generated only in the pixel data write process Wc in one sub-field of the sub-fields SF1–SF14. Therefore, the wall charge formed in the simultaneous reset process Rc of the head sub-field SF1 remains until the aforementioned selective erase discharge is generated and each discharge cell will sustain the state of a "light-emitting cell" Therefore, in the light emission sustain process Ic of each of the sub-fields (shown by white circles) that exist during that period, the sustain discharge that accompanies light emission is generated. At this time, the light emission drive pattern shown in FIG. 10 prohibits the pattern where a discharge cell in which the selective erase discharge is once generated to cause the wall charge to disappear, that is, a "non-light-emitting cell" is transitioned again to a "light-emitting cell" in a subsequent sub-field (within the period of one field). This eliminates the discharge cells that have reversed each others periods of the light-emitting state and the non-light-emitting state within the period of one field, thereby preventing the occurrence of quasi-contours to be visualized on the screen of the PDP 10.

Here, the number of sustain discharge (within the period of one field) generated in each light emission sustain process Ic determines the display brightness that can be expressed on the PDP 10.

For example, in cases where the peak brightness of one field of the input video signal lies within a range of comparatively high brightness of "183"–"255", a drive is effected in accordance with the light emission drive format shown in FIG. 8A. Thus, the display brightness that is obtained by the light emission drive pattern of FIG. 10 becomes the 15 levels shown below. That is,

{0, 1, 4, 9, 16, 27, 40, 56, 75, 97, 122, 151, 182, 217, 256}

That is, the fact that the peak brightness of one field of the input video signal lies within the range of "183"–"255" can give an excellent reason for expecting that the brightness of the input video signal in the one field lies within the range of "0"–"255". Hereupon, at this time, the drive of 15 levels of halftone is carried out to cover the entire range of brightness of "0"–"255" with the fourteen sub-fields SF1–SF14.

On the other hand, in cases where the peak brightness of one field of the input video signal lies within a range of comparatively middle brightness of "92"–"182", a drive is effected in accordance with the light emission drive format shown in FIG. 8B. Thus, the display brightness that is obtained becomes the 14 levels shown below. That is,

{0, 2, 4, 8, 13, 19, 27, 36, 46, 58, 72, 87, 104, 122}

That is, the fact that the peak brightness of one field of the input video signal lies within the range of "92"–"182" can give an excellent reason for expecting that the brightness of the input video signal in the one field lies within the range of "0"–"182". Hereupon, at this time, the drive of 14 levels of halftone is carried out to cover the range of brightness of "0"–"182" with the fourteen sub-fields SF1–SF14.

On the other hand, in cases where the peak brightness of one field of the input video signal lies within a range of comparatively low brightness of "0"–"91", a drive is effected in accordance with the light emission drive format shown in FIG. 8C. Thus, the display brightness that is obtained becomes the 13 levels shown below. That is,

{0, 1, 2, 3, 4, 6, 8, 10, 13, 16, 19, 23, 27}

That is, the fact that the peak brightness of one field of the input video signal lies within the range of "0"–"91" can give an excellent reason for expecting that the brightness of the input video signal in the one field lies within the range of "0"–"91". Hereupon, at this time, the drive of 13 levels of halftone is carried out to cover the range of brightness of "0"–"91" with the fourteen sub-fields SF1–SF14.

As described above, in the present invention, the number of light emissions that should be carried out in the light emission sustain process Ic of each sub-field is changed as shown in FIGS. 8A–8C in accordance with the peak brightness of one field of the input video signal. Such a halftone drive is to be thereby carried out which covers only the predetermined range of brightness ("0"–"91" or "92"–"182") that can be expected by the peak brightness.

According to such a drive method, a difference in brightness between respective levels of halftone can be reduced, so that excellent levels of middle brightness can be obtained.

Furthermore, in the aforementioned embodiment, the peak brightness of the input video signal is recognized as in the three ranks of "0"–"91", "92"–"182", and "183"~"255" and the three types of light emission drive is to be selectively carried out in accordance with each of the ranks as shown in FIGS. 8A–C, however, the present invention is not limited thereto. In other words, the peak brightness rank of the input video signal may be recognized in four ranks or more to carry out selectively one of the four or more types of light emission drive, in which the number of sustain discharges in the period of one field differ from one another, in accordance with the recognized peak brightness rank.

Furthermore, in the aforementioned embodiment, in the pixel data write process Wc of any one of the sub-fields SF1–SF14, the scan pulses SP and the high voltage pixel data pulses are simultaneously applied to allow the selective erase discharge to be generated. However, in some cases where there remains less amount of charged particles in discharge cells, the application of these pulses would not cause the selective erase discharge to be generated and the writing of pixel data to be improperly carried out. Hereupon, in place of the data conversion table and the light emission drive pattern shown in FIG. 10, the data conversion table and the light emission drive pattern shown in FIG. 11 may be employed. Furthermore, the "*" shown in FIG. 11 shows that each bit of the drive pixel data HD may take the logic level either "1" or "0". On the other hand, the triangular mark shows that the selective erase discharge is generated only in the case where the aforementioned mark "*" is equal to logic level "1". In other words, since the initial selective erase discharge may possibly fail to write pixel data, the pixel data is positively written by generating the selective erase discharge again in at least one of the sub-fields that follow thereafter.

In addition, in the aforementioned embodiment, in all of the light emission drive formats of FIG. 8A to FIG. 8C, one field is divided into 14 sub-fields. However, the number of sub-fields into which one field is divided is not limited to fourteen. Moreover, the number of sub-fields may differ depending on each of the peak brightness ranks of the input video signal of one field.

Figure 12:
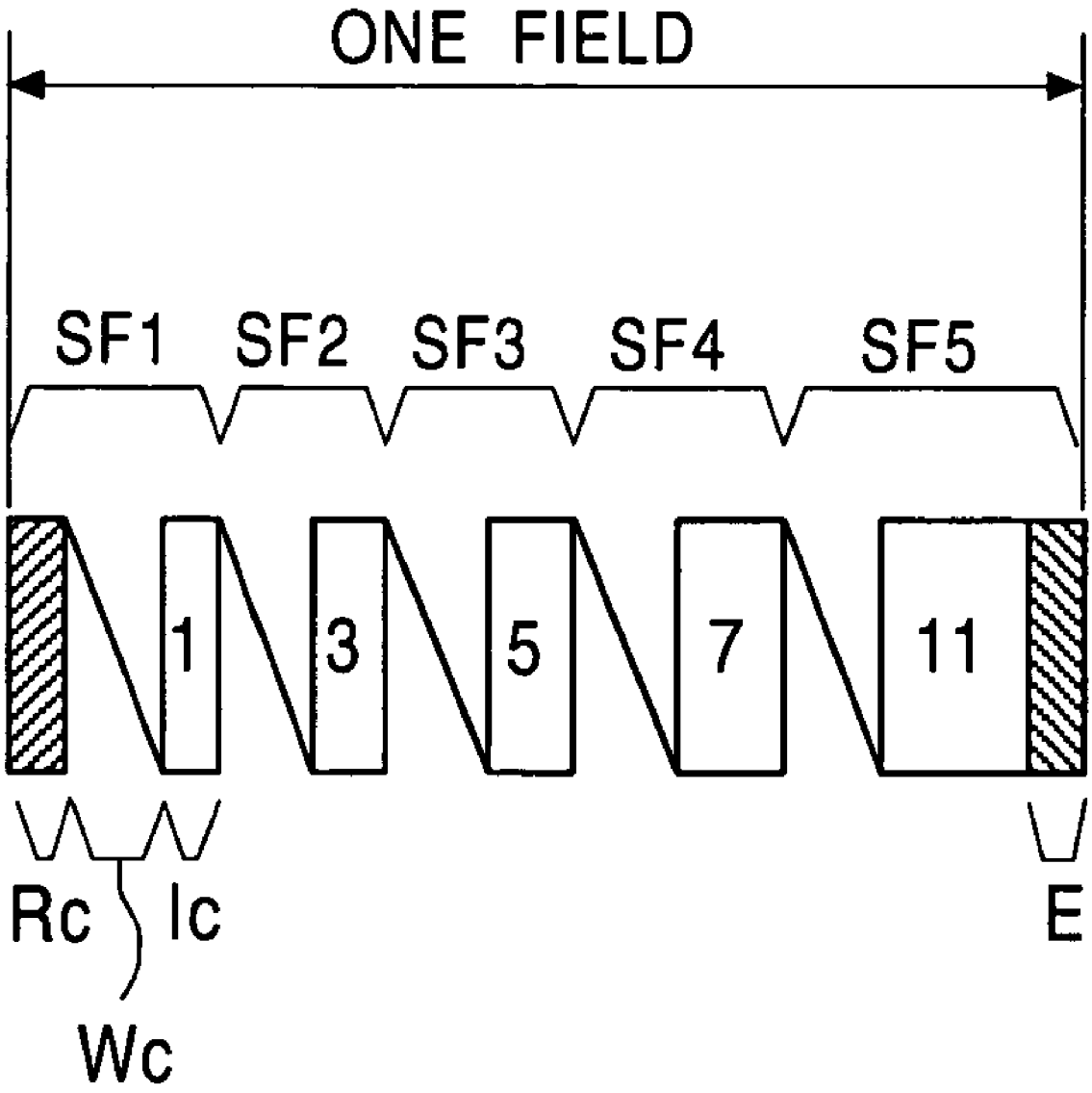
FIG. 12 is a view showing another embodiment of the light emission drive format shown in FIG. 8C.

For example, in cases where the peak brightness of one field of the input video signal is low, that is, if the peak brightness rank signal PL is "01" that shows the low brightness rank, the light emission drive format as shown in FIG. 12 where one field is divided into 5 sub-fields is employed in place of the light emission drive format shown in FIG. 8C to drive the PDP 10.

Figure 13:
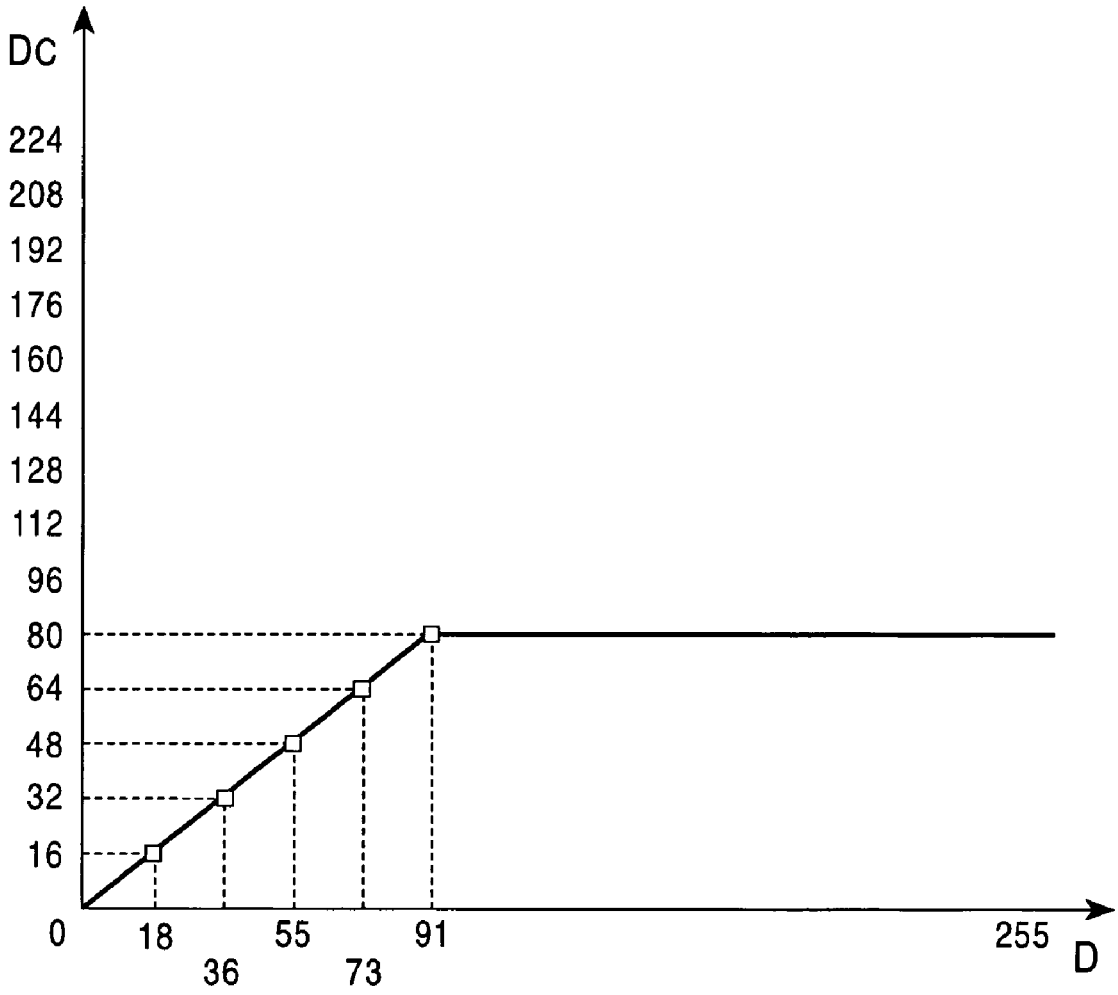
FIG. 13 is view showing the conversion characteristics of the data conversion circuit 324 when a drive is effected in accordance with the light emission drive format shown in FIG. 12.

The light emission drive format shown in FIG. 12 allows the display period of one field to be divided into five sub-fields comprising sub-fields SF1–SF5, and like the case of FIGS. 8A–C, the simultaneous reset process Rc, pixel data write process Wc, the light emission sustain process Ic, and the erase process E to be carried out, respectively. At this time, the data conversion circuit 324 of the first data conversion circuit 32 as shown in FIG. 3 converts the pixel data D into adjusted pixel data Dp using the conversion characteristics shown in FIG. 13 in place of the conversion characteristics as shown in FIG. 6. The multi-level gray scale processing circuit 33 performs the aforementioned multi-level gray scale processing on the adjusted pixel data Dp to determine the multi-level gray scale pixel data Ds. The second data conversion circuit 34 converts the aforementioned multi-level gray scale pixel data Ds into the drive pixel data HD comprising 5 bits using the conversion table shown in FIG. 14 in place of the conversion table shown in FIG. 7 or FIG. 10, and then supplies the drive pixel data HD to the memory 4, only when a drive is carried out in accordance with the light emission drive format shown in FIG. 12. At this time, the memory 4 writes the aforementioned drive pixel data HD in sequence in accordance with a write signal supplied from the drive control circuit 2. After writing a screenful of data (for n rows and m columns) has been completed in the PDP 10 through such writing action, the memory 4 treats each bit digit of the screenful of drive pixel data $HD_{11\text{-}nm}$ as divided into five drive pixel data bits $DB1_{11\text{-}nm}$–$DB5_{11\text{-}nm}$, for example, as shown below.

$DB1_{11\text{-}nm}$: the first bit of the drive pixel data $HD_{11\text{-}nm}$ $DB2_{11\text{-}nm}$: the second bit of the drive pixel data $HD_{11\text{-}nm}$ $DB3_{11\text{-}nm}$: the third bit of the drive pixel data $HD_{11\text{-}nm}$ $DB4_{11\text{-}nm}$: the fourth bit of the drive pixel data $HD_{11\text{-}nm}$ $DB5_{11\text{-}nm}$: the fifth bit of the drive pixel data $HD_{11\text{-}nm}$ Then, the memory 4 reads each of $DB1_{11\text{-}nm}$, $DB2_{11\text{-}nm}$, . . . $DB5_{11\text{-}nm}$ in sequence line by line in accordance with a read signal supplied from the drive control circuit 2 and supplies them to the address driver 6.

Therefore, in the case where the peak brightness rank signal PL showing the peak brightness in the input video signal of one field is equal to "01" that shows the low brightness rank, a drive that is carried out using the light emission drive format shown in FIG. 12 in place of the light emission drive format shown in FIG. 8C provides the display brightness of 6 levels of halftone as shown below.

{0, 1, 5, 14, 30, 57}

As such, the number of divided sub-fields is reduced from 14 to 5, thereby reducing power consumption.

Moreover, in the multi-level gray scale processing circuit 33 according to the aforementioned embodiment, the error diffusion processing and the dither processing are performed on the 8-bit adjusted pixel data Dp, thereby determining the multi-level gray scale pixel data Ds the number of bits of which is reduced to 4 bits. However, in the case where the peak brightness is low in one field of input video signal, the number of compressed bits in the error diffusion processing and the dither processing in the multi-level gray scale processing circuit 33 may be reduced in order to reduce noise.

Figure 15:
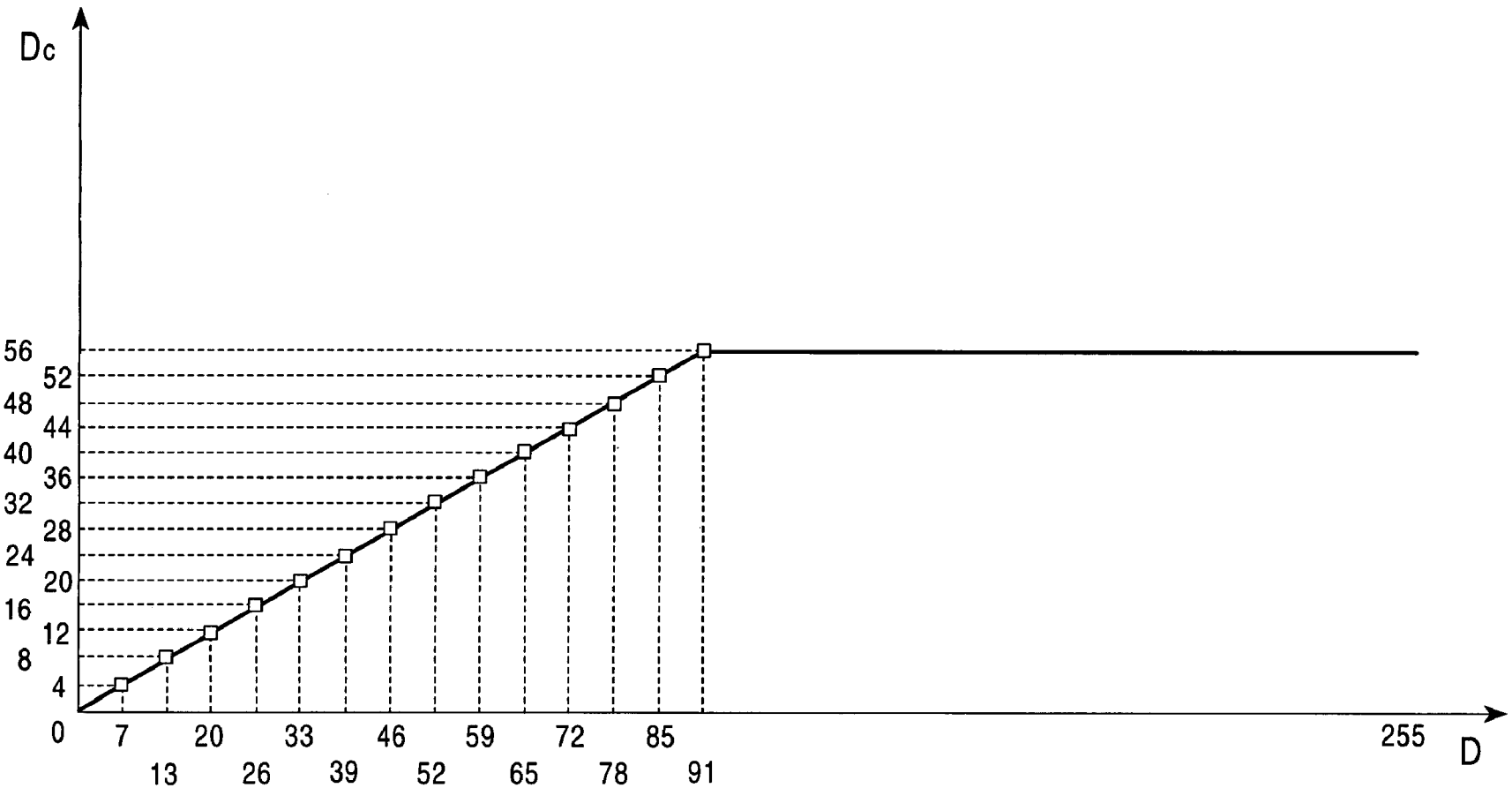
FIG. 15 is a view showing the conversion characteristics used in the data conversion circuit 324 when the number of compressed bits provided by a multi-level gray scale processing circuit 33 is reduced from four bits to 2 bits.

FIG. 15 shows the conversion characteristics to be used in the aforementioned data conversion circuit 324 when the number of compressed bits is reduced from four bits to two bits by the error diffusion processing and the dither processing in the multi-level gray scale processing circuit 33. FIG. 16 shows the data conversion table to be used in the second data conversion circuit 34.

In addition, the aforementioned embodiment is adapted to select one of the light emission drive formats as shown in FIG. 8A to FIG. 8C, which corresponds to the peak brightness in one field of input video signal, and to drive the PDP 10 in accordance with the selected light emission drive format. However, in place of this peak brightness, a light emission drive format may be selected based on the dynamic range in one field of input video signal.

Figure 17:
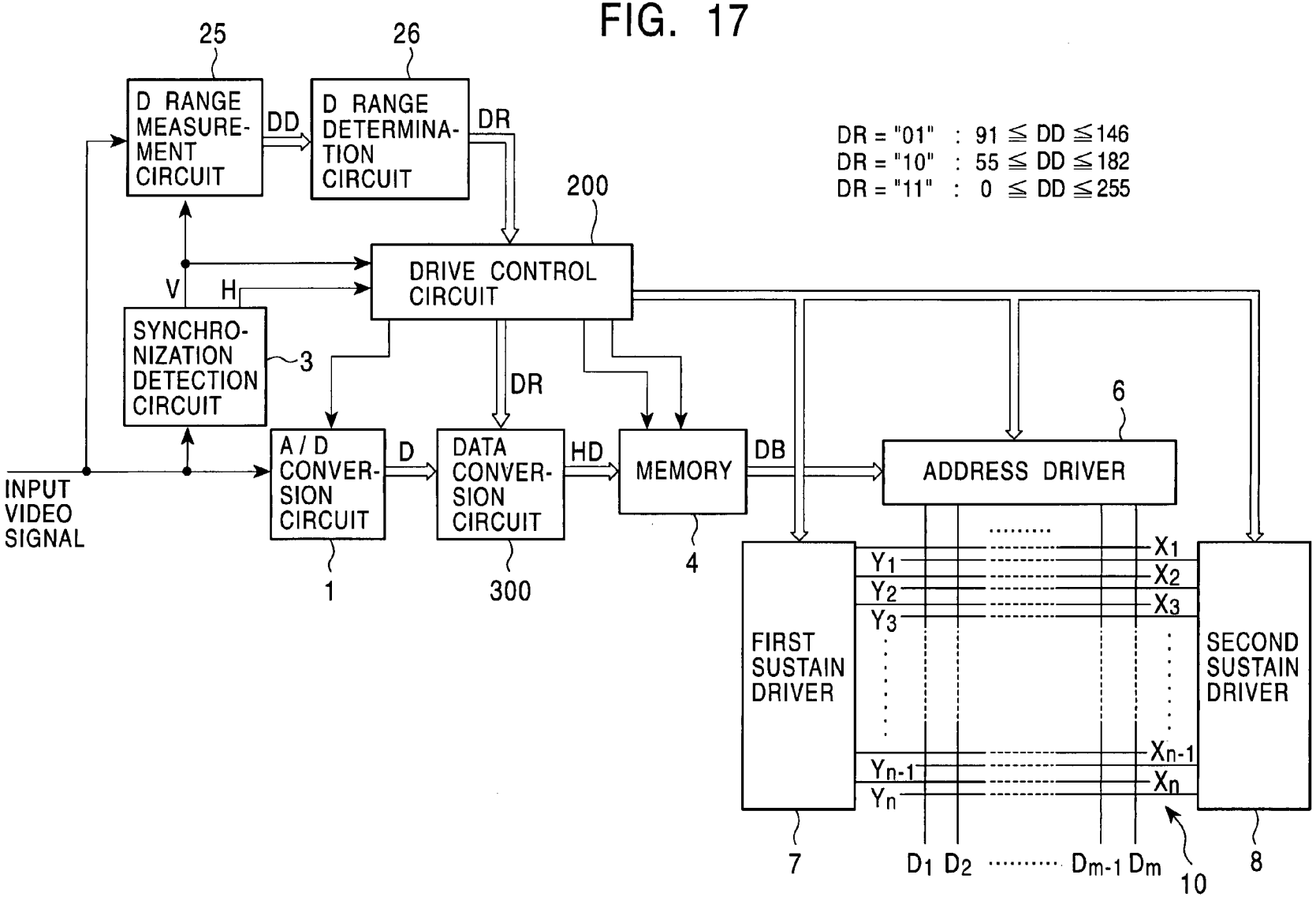
FIG. 17 is a schematic view showing another example of the configuration of a plasma display device for driving a plasma display panel in accordance with the drive method according to the present invention.

FIG. 17 shows another configuration of a plasma display device that was developed in view of such a point. Furthermore, the configuration of the PDP 10 shown in FIG. 17 as a plasma display device is the same as that shown in FIG. 1 and thus its detailed explanation is omitted.

Referring to FIG. 17, the A/D converter 1 samples the analog input video signal on which the γ correction processing has been performed beforehand, in accordance with a clock signal supplied from a drive control circuit 200 and converts the signal into pixel data D for each pixel, which is in turn supplied to a data conversion circuit 300. Furthermore, such pixel data D is 8-bit data by which the brightness of 256 levels of halftone, comprising "0"–"255", can be expressed.

The synchronization detector circuit 3 generates the vertical synchronization detection signal V when a vertical synchronization signal is detected in the aforementioned input video signal, and supplies the vertical synchronization detection signal V to a dynamic range measurement circuit 25 and the drive control circuit 200, respectively. Moreover, the synchronization detector circuit 3 generates the horizontal synchronization detection signal H when a horizontal synchronization signal is detected in the input video signal, and supplies the horizontal synchronization detection signal H to the drive control circuit 200.

The dynamic range measurement circuit 25 detects each of the maximum and minimum brightness levels in every one field of the aforementioned input video signal, thereby measuring every one field of dynamic range. Then, the dynamic range determination circuit 25 supplies a dynamic range signal DD that shows the measured dynamic range to a dynamic range determination circuit 26. In the case where the dynamic range, which is shown by the dynamic range signal DD, lies within the range of brightness of "91"–"146", the dynamic range determination circuit 26 supplies the dynamic range determination signal DR of "01" that shows a narrow brightness range to the drive control circuit 200 and the data conversion circuit 300, respectively. In addition, in the case where the dynamic range, which is shown by the aforementioned dynamic range signal DD, lies within the range of brightness of "55"–"182", the dynamic range determination circuit 26 supplies the dynamic range determination signal DR of "10" that shows a middle brightness range to the drive control circuit 200 and the data conversion circuit 300, respectively. Moreover, in a case where the dynamic range, which is shown by the aforementioned dynamic range signal DD, lies within the entire range of brightness of "0"–"255", the dynamic range determination circuit 26 supplies the dynamic range determination signal DR of "11" that shows a wide brightness range to the drive control circuit 200 and the data conversion circuit 300, respectively.

Figure 18:
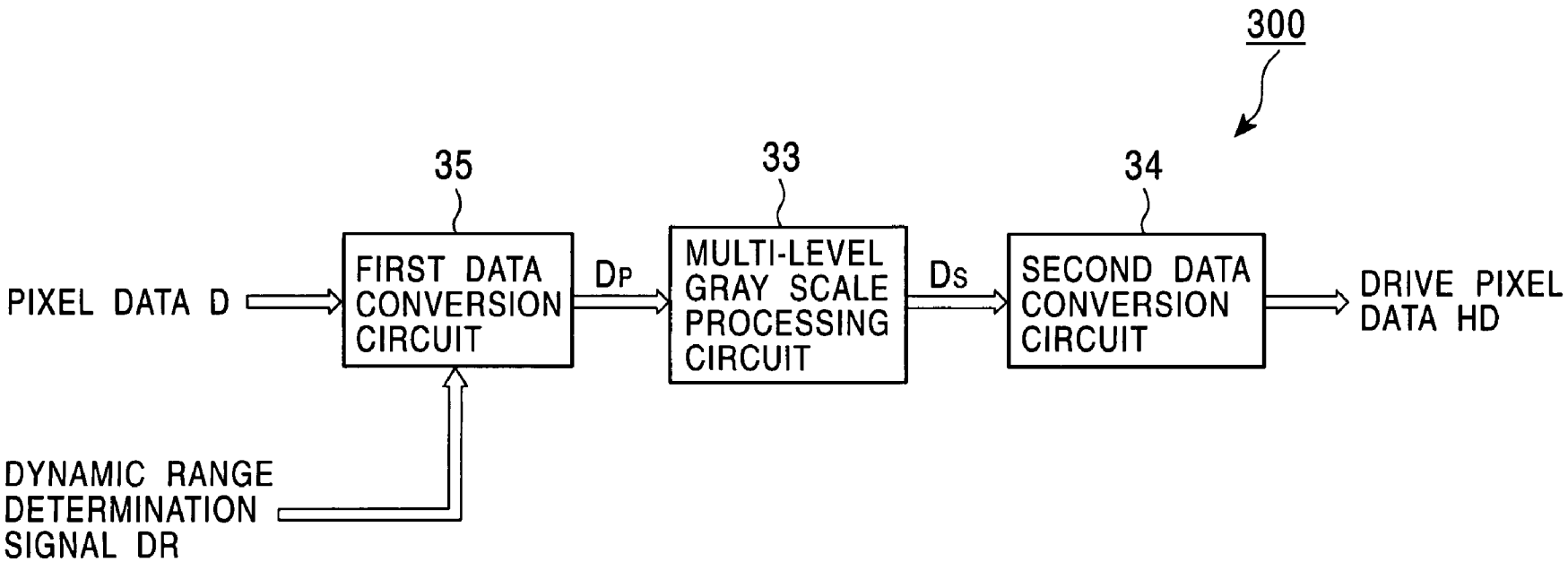
FIG. 18 is view showing the internal configuration of a data conversion circuit 300 in the plasma display device shown in FIG. 17.

FIG. 18 is a view showing the internal configuration of such data conversion circuit 300.

Referring to FIG. 18, a first data conversion circuit 35 converts the value of data of the aforementioned pixel data D that can express the brightness of 256 levels of halftone with 8 bits of "0"–"255" into adjusted pixel data Dp having the range thereof adjusted to "0"–"224", and supplies the adjusted pixel data Dp to the multi-level gray scale processing circuit 33. Furthermore, the conversion characteristics of such first data conversion circuit 35 from the pixel data D to the adjusted pixel data Dp corresponds to the dynamic range determination signal DR.

Figure 19:
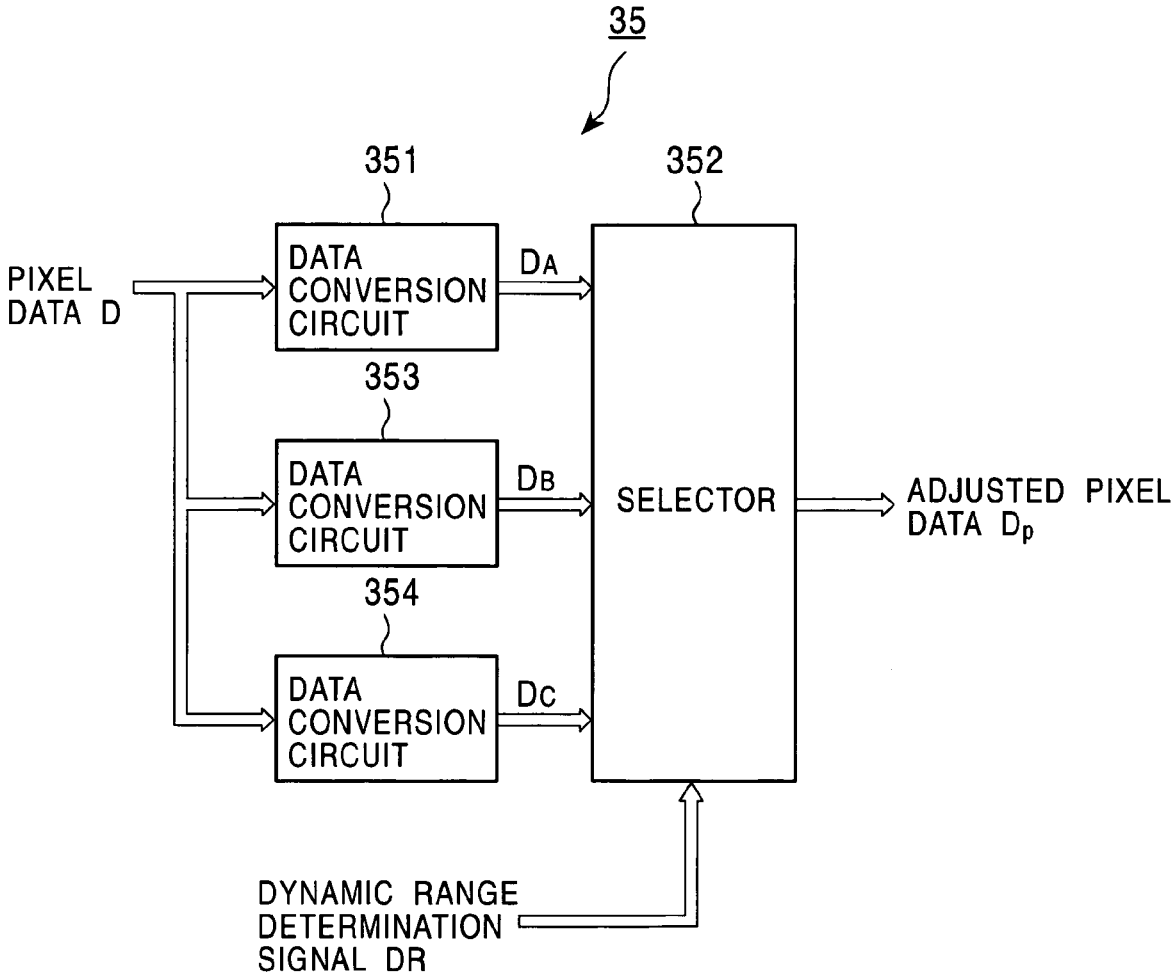
FIG. 19 is view showing the internal configuration of a first data conversion circuit 35.

FIG. 19 is a view showing the internal configuration of such first data conversion circuit 35.

Figure 20:
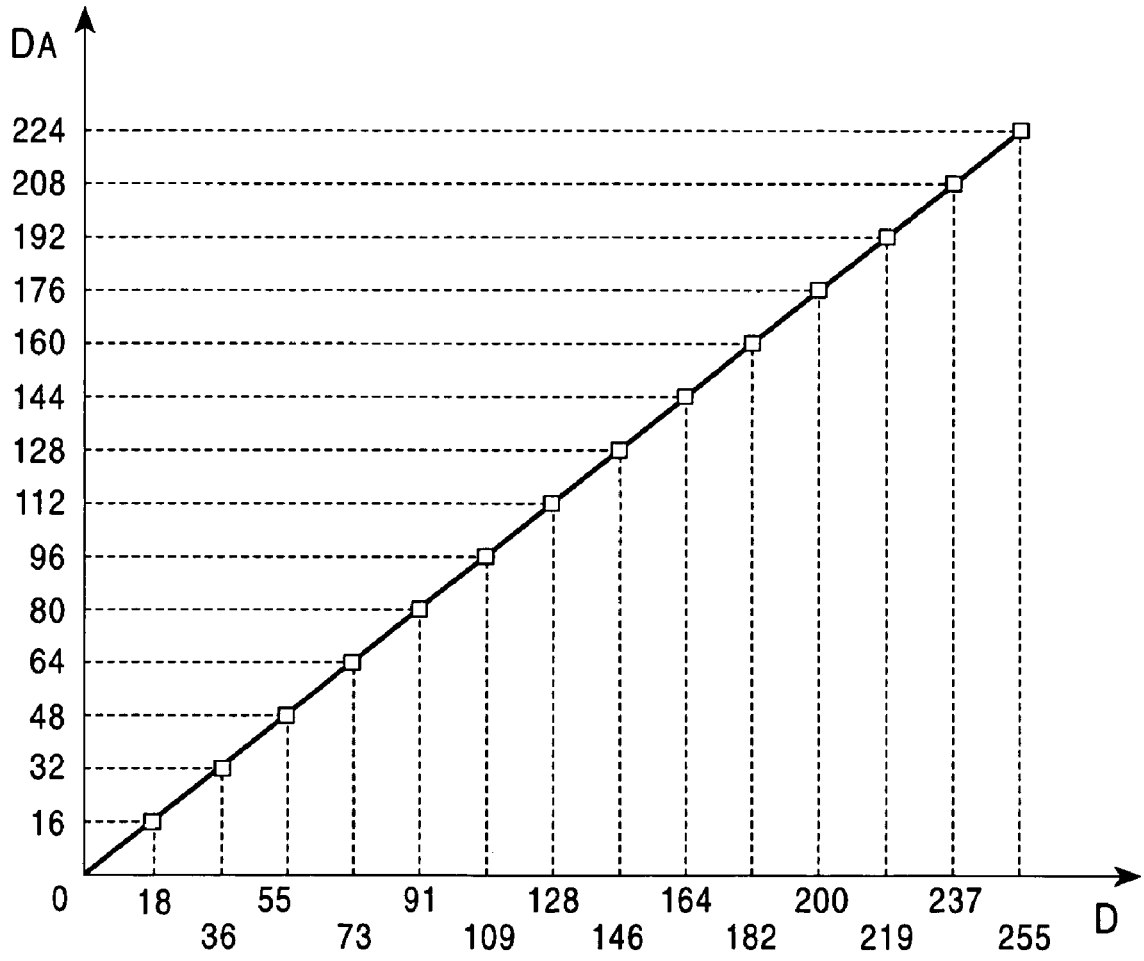
FIG. 20 is view showing the conversion characteristics of a data conversion circuit 351.
Figure 21:
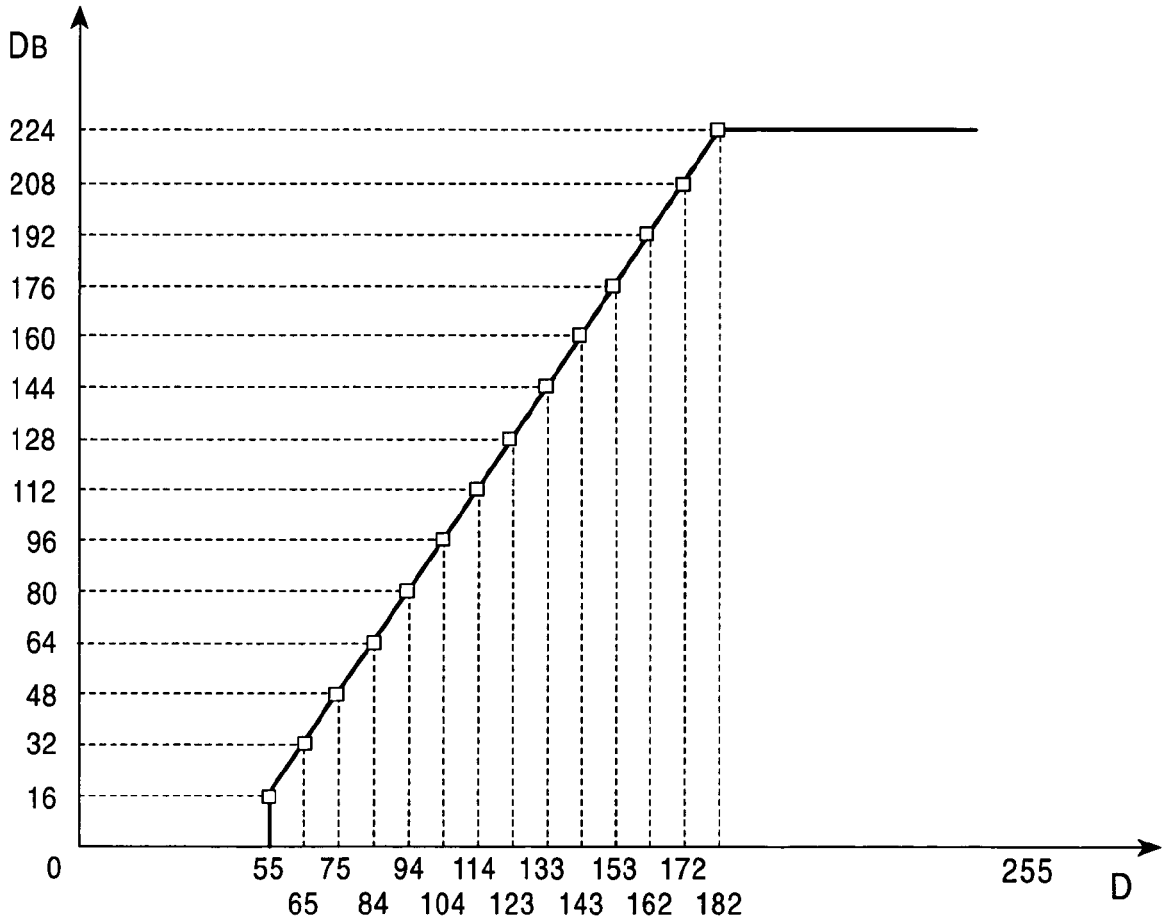
FIG. 21 is view showing the conversion characteristics of a data conversion circuit 353.
Figure 22:
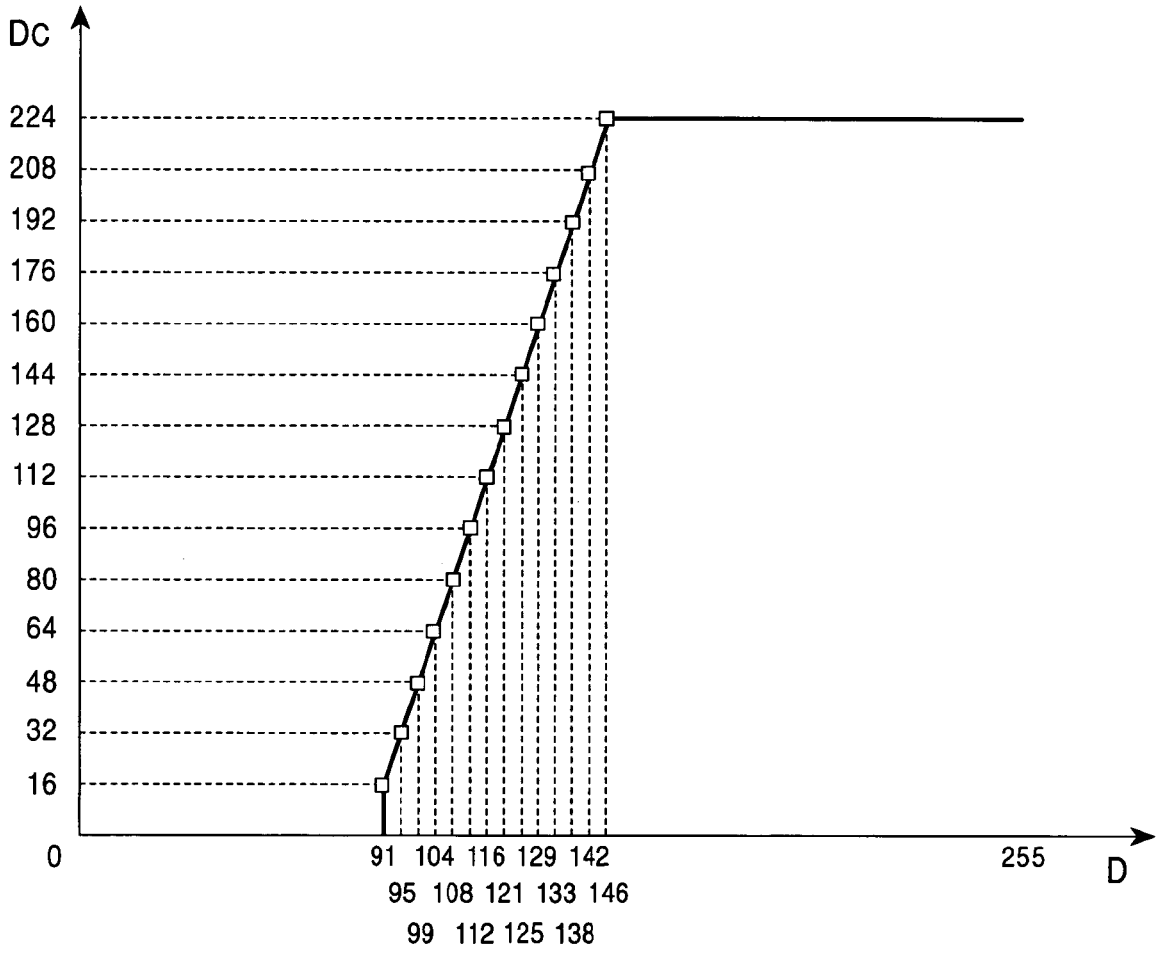
FIG. 22 is view showing the conversion characteristics of a data conversion circuit 354.

Referring to FIG. 19, the first data conversion circuit 351 converts the aforementioned pixel data D into pixel data $D_A$ having the range of brightness of "0"–"224" of 8 bits in accordance with the conversion characteristics as shown in FIG. 20, and then supplies the pixel data $D_A$ to a selector 352. A data conversion circuit 353 converts the aforementioned pixel data D into pixel data DB having the range of brightness of "0"–"224" of 8 bits in accordance with the conversion characteristics as shown in FIG. 21, and then supplies the pixel data $D_B$ to the selector 352. A data conversion circuit 354 converts the aforementioned pixel data D into pixel data $D_C$ having the range of brightness of "0"–"224" of 8 bits in accordance with the conversion characteristics as shown in FIG. 22, and then supplies the pixel data $D_C$ to the selector 352. The selector 352 selects one of the aforementioned pixel data $D_A$, $D_B$, and $D_C$, which corresponds to the aforementioned dynamic range determination signal DR, and then outputs the one as the adjusted pixel data Dp. That is, in a case where the aforementioned dynamic range determination signal DR is equal to "01", that is, if the dynamic range of the input video signal lies in the range of brightness of "91"–"146", the selector 352 uniquely selects the pixel data $D_C$ among the aforementioned pixel data $D_A$, $D_B$, $D_C$ and then outputs the pixel data $D_C$ as the adjusted pixel data Dp. Moreover, in a case where the aforementioned dynamic range-determination signal DR is equal to "10", that is, if the dynamic range of the input video signal lies in the range of brightness of "55"–"182", the selector 352 uniquely selects the pixel data $D_B$, and then outputs the pixel data $D_B$ as the adjusted pixel data Dp. In addition, in a case where the aforementioned dynamic range determination signal DR is equal to "11", that is, if the dynamic range of the input video signal lies in the entire range of brightness of "0"–"255", the selector 352 uniquely selects the pixel data $D_A$, and then outputs the pixel data $D_A$ as the adjusted pixel data Dp.

The multi-level gray scale processing circuit 33 of FIG. 18 performs error diffusion processing and dither processing on the aforementioned 8-bit adjusted pixel data Dp, thereby determining multi-level gray scale pixel data Ds that is provided with the number of the bits thereof compressed to 4 bits while maintaining the number of visual brightness expression levels of halftone to substantially 256 levels of halftone. Then, the multi-level gray scale processing circuit 33 supplies the multi-level gray scale pixel data Ds to the second data conversion circuit 34. The second data conversion circuit 34 converts the multi-level gray scale pixel data Ds into the drive pixel data HD of 14 bits (from the first to the fourteenth bit) for driving one pixel, in accordance with the conversion table as shown in FIG. 7, and then supplies the drive pixel data HD to the memory 4.

The memory 4 writes the aforementioned drive pixel data HD in sequence in accordance with a write signal supplied from the drive control circuit 200. After writing a screenful of data (for n rows and m columns) has been completed in the PDP 10 through such writing action, the memory 4 treats each bit digit of the screenful of drive pixel data $HD_{11\text{-}nm}$ as divided into fourteen drive pixel data bits $DB1_{11\text{-}nm}$–$DB14_{11\text{-}nm}$ as follows. That is, $DB1_{11\text{-}nm}$: the first bit of the drive pixel data $HD_{11\text{-}nm}$ $DB2_{11\text{-}nm}$: the second bit of the drive pixel data $HD_{11\text{-}nm}$ $DB3_{11\text{-}nm}$: the third bit of the drive pixel data $HD_{11\text{-}nm}$ $DB4_{11\text{-}nm}$: the fourth bit of the drive pixel data $HD_{11\text{-}nm}$ $DB5_{11\text{-}nm}$: the fifth bit of the drive pixel data $HD_{11\text{-}nm}$ $DB6_{11\text{-}nm}$: the sixth bit of the drive pixel data $HD_{11\text{-}nm}$ $DB7_{11\text{-}nm}$: the seventh bit of the drive pixel data $HD_{11\text{-}nm}$ $DB8_{11\text{-}nm}$: the eighth bit of the drive pixel data $HD_{11\text{-}nm}$ $DB9_{11\text{-}nm}$: the ninth bit of the drive pixel data $HD_{11\text{-}nm}$ $DB10_{11\text{-}nm}$: the tenth bit of the drive pixel data $HD_{11\text{-}nm}$ $DB11_{11\text{-}nm}$: the eleventh bit of the drive pixel data $HD_{11\text{-}nm}$ $DB12_{11\text{-}nm}$: the twelfth bit of the drive pixel data $HD_{11\text{-}nm}$ $DB13_{11\text{-}nm}$: the thirteenth bit of the drive pixel data $HD_{11\text{-}nm}$ $DB14_{11\text{-}nm}$: the fourteenth bit of the drive pixel data $HD_{11\text{-}nm}$ Then, the memory 4 reads each of $DB1_{11\text{-}nm}$, $DB2_{11\text{-}nm}$, . . . $DB14_{11\text{-}nm}$ in sequence, line by line, in accordance with a read signal supplied from the drive control circuit 2 and supplies them to the address driver 6.

The drive control circuit 200 generates a clock signal for the A/D converter 1, and a write signal and a read signal for the memory 4 in synchronization with the aforementioned horizontal synchronization detection signal H and the vertical synchronization detection signal V, which are supplied from the synchronization detector circuit 3. Moreover, the drive control circuit 200 selects one of the light emission drive formats shown in FIG. 23A–FIG. 23C, which corresponds to the aforementioned dynamic range determination signal DR. In accordance with this format, the drive control circuit 200 supplies various types of timing signals for driving the PDP 10 to the address driver 6, a first sustain driver 7, and a second sustain driver 8, respectively.

Furthermore, the light emission drive format shown in FIG. 23A–FIG. 23C allow the operation described below to be carried out in each of the 14 sub-fields SF1–SF14 into which the display period of one field is divided. That is, in each sub-field, the formats allow for executing the pixel data write process Wc for writing pixel data into each of the discharge cells of the PDP 10 to set the cell to a "light-emitting cell" or "non-light-emitting cell", and the light emission sustain process Ic for allowing only the aforementioned "light-emitting cell" to emit light for the number (periods) shown in FIG. 23 to sustain the light emission state. In addition, the formats allow the simultaneous reset process Rc for resetting the wall charge in all discharge cells of the PDP 10 to be executed only in the head sub-field SF1, and the erase process E for erasing simultaneously the wall charge in the all discharge cells to be executed only in the last sub-field SF14.

In order to implement the aforementioned operation in each of the simultaneous reset process Rc, the pixel data write process Wc, the light emission sustain process Ic, and the erase process E, each of the address driver 6, the first sustain driver 7, and the second sustain driver 8 applies each of the various drive pulses to each of the electrode columns $D_1$–$D_m$, the electrode rows $X_1$–$X_n$, and $Y_1$–$Y_n$ of the PDP 10.

Figure 24:
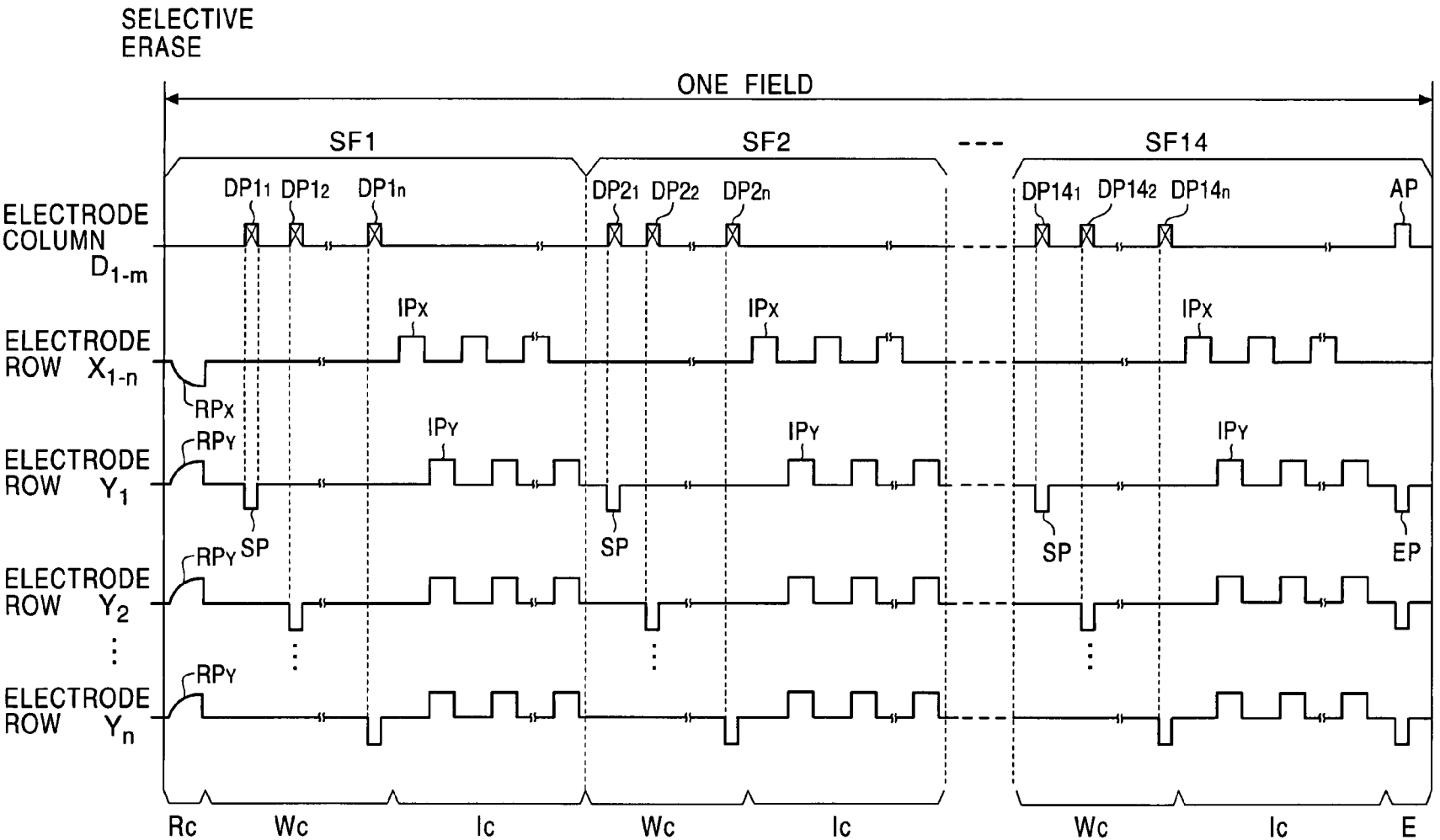
FIG. 24 is a view showing the application timing of various types of drive pulses to be applied to a PDP 10 of the plasma display device shown in FIG. 17.

FIG. 24 is a view showing an example of the application timing of such drive pulses.

First, in the simultaneous reset process Rc in the head sub-field SF1, the first sustain driver 7 and the second sustain driver 8 apply a reset pulse RPx of negative polarity and a reset pulse RPy of positive polarity to the electrode rows $X_1$–$X_n$ and $Y_1$–$Y_n$ at the same time. The application of these reset pulses RPx and RPy allows reset discharge to be carried out in all discharge cells of the PDP 10, and thus uniform wall charge of a predetermined quantity is built up in respective discharge cells. That is, this allows all discharge cells of the PDP 10 to be once reset to "light-emitting cells".

Next, in the pixel data write process Wc of each sub-field, the address driver 6 generates pixel data pulses that have a voltage corresponding to the logic level of the drive pixel data bit DB supplied from the aforementioned memory 4 and applies the pixel data pulses to the electrode columns $D_{1\text{-}m}$ line by line in sequence. That is, first, in the pixel data write process Wc of sub-field SF1, a data bit corresponding to the first line, that is, $DB1_{11\text{-}1m}$ is extracted from the aforementioned drive pixel data bits $DB1_{11\text{-}nm}$. Then a group of pixel data pulses $DP1_1$ comprising m pixel data pulses corresponding to each of the logic level of $DB1_{11\text{-}1m}$ is generated and applied to the electrode columns $D_{1\text{-}m}$. Next, $DB1_{21\text{-}2m}$ corresponding to the second line is extracted from the drive pixel data bits $DB1_{11\text{-}nm}$. Then a group of pixel data pulses $DP1_2$ comprising m pixel data pulses corresponding to each of the logic level of $DB1_{21\text{-}2m}$ is generated and applied to the electrode columns $D_{1\text{-}m}$. Subsequently, likewise, in the pixel data write process Wc of the sub-field SF1, a group of pixel data pulses $DP1_3$–$DP1_n$ is applied in sequence to the electrode columns $D_{1\text{-}m}$ line by line. In the pixel data write process Wc of sub-field SF2, first, a data bit corresponding to the first line, that is, $DB2_{11\text{-}1m}$ is extracted from the aforementioned drive pixel data bits $DB2_{11\text{-}nm}$. Then a group of pixel data pulses $DP2_1$ comprising m pixel data pulses corresponding to each of the logic level of $DB2_{11-1m}$ is generated and applied to the electrode columns $D_{1-m}$. Next, $DB2_{21-2m}$ corresponding to the second line is extracted from the drive pixel data bits $DB21_{11-nm}$. Then a group of pixel data pulses $DP2_2$ comprising m pixel data pulses corresponding to each of the logic level of $DB2_{21-2m}$ is generated and applied to the electrode columns $D_{1-m}$. Subsequently, likewise, in the pixel data write process Wc of the sub-field SF2, a group of pixel data pulses $DP2_3$–$DP2_n$ is applied in sequence to the electrode columns $D_{1-m}$ line by line. Subsequently, likewise, in the pixel data write process Wc in each of sub-field SF3–SF14, each of the groups of pixel data pulses $DP3_{1-n}$–$DP14_{1-n}$ generated based on each of the drive pixel data bits $DB3_{1-n}$–$DB14_{11-nm}$ is assigned to each of sub-fields SF3–SF14 and applied to the electrode columns $D_{1-m}$ by the address driver 6. Furthermore, it is to be understood that the address driver 6 generates high voltage pixel data pulses when the drive pixel data bit DB has a logic level "1", while generating low voltage pixel data pulses (zero volt) when the drive pixel data bit DB has a logic level "0".

Moreover, in the pixel data write process Wc of each sub-field, the second sustain driver 8 generates scan pulses SP of negative polarity as shown in FIG. 24 at the same timing as the application timing of each of the aforementioned groups of pixel data pulses DP and applies the pulses in sequence to the electrode rows $Y_1$ through $Y_n$. At this time, discharge (selective erase discharge) is produced only in the discharge cells located at the intersections of the "rows" to which the scan pulse SP is applied and the "columns" to which a high voltage pixel data pulse is applied, so that the wall charge remaining within the discharge cells are selectively erased. That is, the logic level of each of the first to the fourteenth bits of the drive pixel data HD as shown in FIG. 7 is to determine whether the selective erase discharge should be generated in the pixel data write process Wc of each sub-field SF1–SF14. This selective erase discharge causes the discharge cells that have been reset to the state of a "light-emitting cell" at the aforementioned simultaneous reset process Rc to change to a "non-light-emitting cell". Furthermore, the discharge cells that are formed in the "columns" to which the aforementioned high voltage pixel data pulses have not been applied are provided with no discharge, but are sustained in the state of being reset in the aforementioned simultaneous reset process Rc, that is, to the state of a "light-emitting cell". That is, either a "light-emitting cell" in which sustain discharge is generated in the immediately subsequent light emission sustain process Ic or a "non-light-emitting cell" in which no sustain discharge is generated is selectively set corresponding to the pixel data in the pixel data write process Wc carried out in each sub-field.

Next, in the light emission sustain process Ic of each sub-field, the first sustain driver 7 and the second sustain driver 8 apply sustain pulses $IP_X$ and $IP_Y$ of positive polarity alternately as shown in FIG. 24 to the electrode rows $X_1$–$X_n$ and $Y_1$–$Y_n$. Here, the number of the sustain pulses IP that should be applied in the light emission sustain process Ic of each sub-field differs depending on the light emission drive format to be used in accordance with the aforementioned dynamic range determination signal DR.

Figures 23A, 23B, 23C:
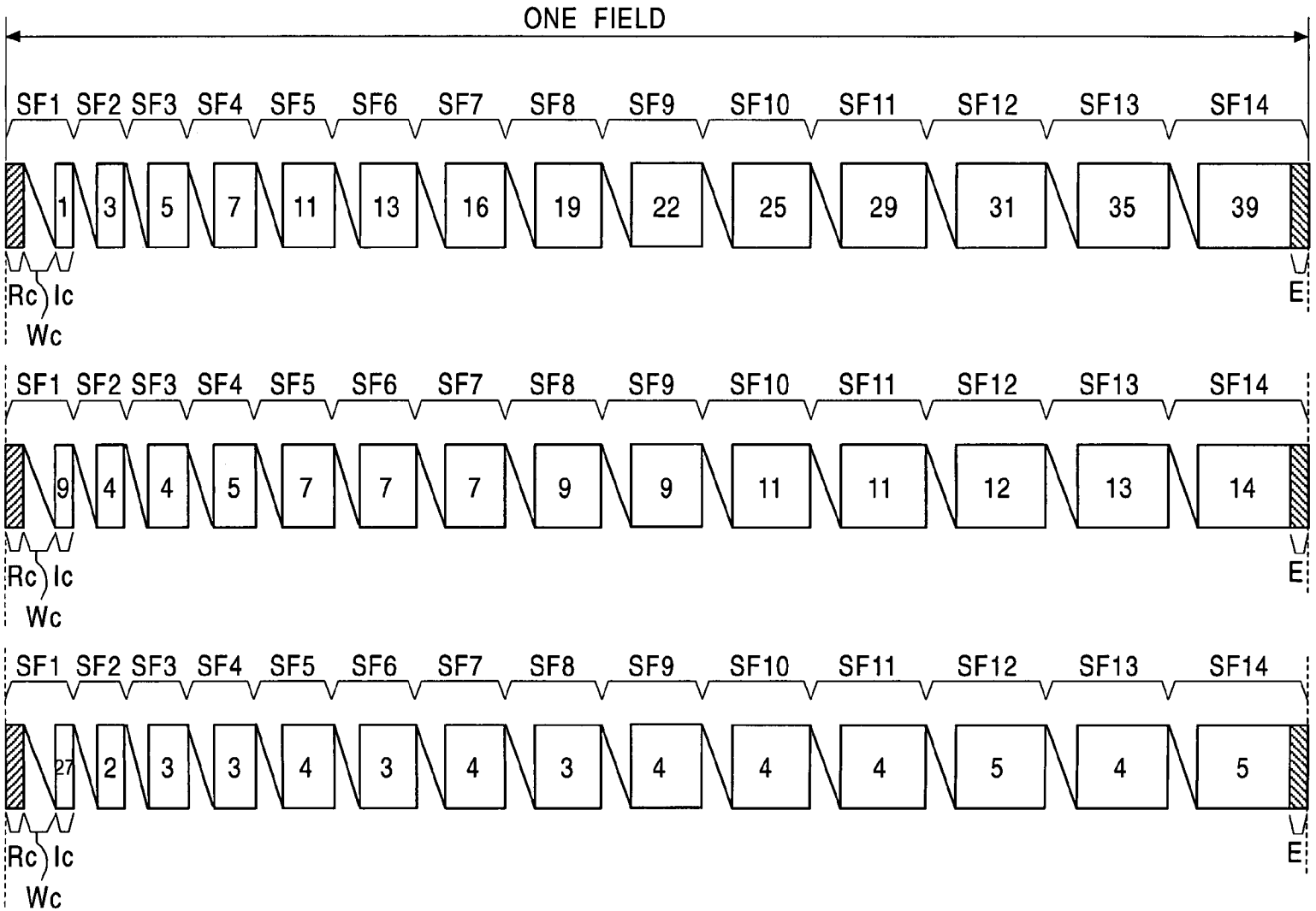
FIG. 23A through FIG. 23C show the light emission drive format of the plasma display device shown in FIG. 17.

That is, in the case where the dynamic range determination signal DR is equal to "11" that shows the high brightness range, a drive is carried out in accordance with the light emission drive format shown in FIG. 23A. Therefore, at this time, the number of sustain pulses IP to be applied in the light emission sustain process Ic of each sub-field is as follows. That is,

SF1: 1,

SF2: 3,

SF3: 5,

SF4: 7,

SF5: 11,

SF6: 13,

SF7: 16,

SF8: 19,

SF9: 22,

SF10: 25,

SF11: 29,

SF12: 31,

SF13: 35, and

SF14: 39.

Moreover, in the case where the dynamic range determination signal DR is equal to "10" that shows the middle brightness range, a drive is carried out in accordance with the light emission drive format shown in FIG. 23B. Therefore, the number of sustain pulses IP to be applied in the light emission sustain process Ic of each sub-field is as follows. That is,

SF1: 9,

SF2: 4,

SF3: 4,

SF4: 5,

SF5: 7,

SF6: 7,

SF7: 7,

SF8: 9,

SF9: 9,

SF10: 11,

SF11: 11,

SF12: 12,

SF13: 13, and

SF14: 14.

Moreover, in the case where the dynamic range determination signal DR is equal to "01" that shows the narrow brightness range, a drive is carried out in accordance with the light emission drive format shown in FIG. 23C. Therefore, the number of sustain pulses IP to be applied in the light emission sustain process Ic of each sub-field is as follows. That is,

SF1: 27,

SF2: 2,

SF3: 3,

SF4: 3,

SF5: 4,

SF6: 3,

SF7: 4,

SF8: 3,

SF9: 4,

SF10: 4,

SF11: 4,

SF12: 5,

SF13: 4, and

SF14: 5.

The application of the sustain pulses IP allows only the discharge cells in which wall charge remains in the aforementioned pixel data write process Wc, that is, the "light-emitting cells" to carry out sustain discharge every time the aforementioned sustain pulses IPx and IPy are applied thereto to sustain the light emission state generated by the discharge for the aforementioned number (periods). At this time, the ratio of the number of sustain discharges that should be carried out in each of the sub-fields SF1–SF14 is an inverse γ ratio and the γ characteristic applied to the pixel data D corresponding to the input video signal is released.

Finally, in the erase process E carried out at the last sub-field SF14, the address driver 6 generates the erase pulse AP as shown in FIG. 24 and then applies the pulse to the electrode columns $D_{1-m}$. The second sustain driver 8 generates an erase pulse EP and applies the pulse to the electrode rows $Y_1$–$Y_n$ at the same time as the application timing of the erase pulse AP. The simultaneous application of the erase pulses AP and EP allows the erase discharge to be generated in all discharge cells of the PDP 10, so that the wall charge remaining in all discharge cells disappears. That is, the erase discharge causes all discharge cells in the PDP 10 to change to "non-light-emitting cells".

FIG. 25 show the light emission drive pattern of the PDP 10 in the case where a drive is carried out in accordance with the light emission drive format shown in FIG. 23A–FIG. 23C based on the drive pixel data HD as shown in FIG. 7.

According to such drive pixel data HD, as shown in FIG. 25 by the black circles, the selective erase discharge is generated only in the pixel data write process Wc in one sub-field of the sub-fields SF1–SF14. Therefore, the wall charge formed in the simultaneous reset process Rc of the head sub-field SF1 remains until the aforementioned selective erase discharge is generated and each discharge cell will sustain the state of a "light-emitting cell". Therefore, in the light emission sustain process Ic of each of the sub-fields (shown by white circles) that exist during that period, the sustain discharge that accompanies light emission is generated. At this time, the light emission drive pattern shown in FIG. 25 prohibits the pattern where a discharge cell in which the selective erase discharge is once generated to cause the wall charge to disappear, that is, a "non-light-emitting cell" is transitioned again to a "light-emitting cell" in a subsequent sub-field (within the period of one field). This eliminates the discharge cells that have reversed periods of the light-emitting state and the non-light-emitting state within the period of one field, thereby preventing the occurrence of quasi-contours to be visualized on the screen of the PDP 10.

Here, the number of sustain discharges (within the period of one field) generated in each light emission sustain process Ic determines the display brightness that can be expressed on the PDP 10.

For example, in cases where the dynamic range of one field of input video signal lies within such a wide range of brightness as covers the entire range of "0"–"255", a drive is effected in accordance with the light emission drive format shown in FIG. 23A. Thus, the display brightness that is obtained by the light emission drive pattern shown in FIG. 25 becomes the 15 levels shown below. That is,

{0, 1, 4, 9, 16, 27, 40, 56, 75, 97, 122, 151, 182, 217, 256}

On the other hand, in cases where the dynamic range of one field of input video signal has such a middle range of brightness as lies within the range of "55"–"182", a drive is effected in accordance with the light emission drive format shown in FIG. 23B. Thus, the display brightness obtained becomes the 15 levels shown below. That is,

{0, 9, 13, 17, 22, 29, 35, 43, 52, 61, 72, 83, 95, 108, 122}

Furthermore, in cases where the dynamic range of one field of input video signal has such a narrow range of brightness as lies within the range of "91"–"146", a drive is effected in accordance with the light emission drive format shown in FIG. 23C. Thus, the display brightness that is obtained by the light emission drive pattern becomes the 15 levels shown below. That is,

{0, 27, 29, 32, 35, 39, 42, 46, 49, 53, 57, 61, 66, 70, 75}

As described above, the plasma display device shown in FIG. 17 detects a dynamic range (the range of brightness) of every one field of the input video signal and changes the number of light emissions that should be carried out in the light emission sustain process Ic of each sub-field, in accordance with the dynamic range as shown in FIG. 23A–FIG. 23C. This allows for carrying out a drive of 15 levels of halftone that covers only the range of brightness shown by the dynamic range, thereby reducing a difference in brightness between respective levels of halftone and providing excellent levels of halftone.

Furthermore, in the light emission drive pattern shown in FIG. 25, in the pixel data write process Wc of any one of the sub-fields SF1–SF14, the scan pulses SP and the high voltage pixel data pulses are simultaneously applied to allow the selective erase discharge to be generated. However, in some cases where there remains less amount of charged particles in discharge cells, the application of these pulses would not cause the selective erase discharge to be generated and the writing of pixel data to be improperly carried out. Hereupon, in place of the data conversion table and the light emission drive pattern shown in FIG. 25, the data conversion table and the light emission drive pattern shown in FIG. 26 may be employed to drive the PDP 10. Furthermore, the "*" shown in FIG. 26 shows that each bit of the drive pixel data HD may take the logic level of either "1" or "0". On the other hand, the triangular mark shows that the selective erase discharge is generated only in the case where the aforementioned mark "*" is equal to logic level "1". In other words, since the initial selective erase discharge may possibly fail to write pixel data, the pixel data is positively written by generating the selective erase discharge again in at least one of the sub-fields that follow thereafter.

In addition, in the light emission drive format shown in FIG. 23A–FIG. 23C, one field is divided into 14 sub-fields. However, the number of sub-fields into which one field is divided is not limited to fourteen. Moreover, the number of divided sub-fields may differ in accordance with the dynamic range of one field of input video signal.

Figure 27:
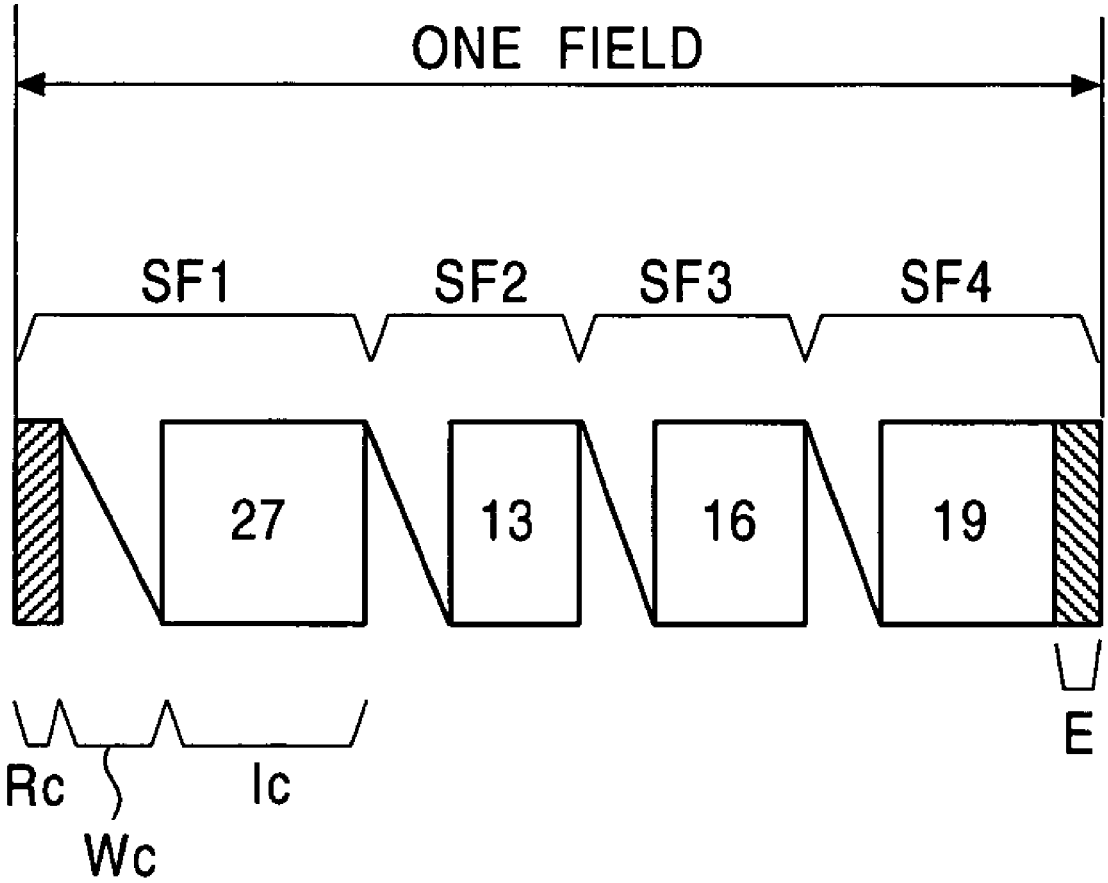
FIG. 27 is a view showing another embodiment of the light emission drive format shown in FIG. 23C.

For example, in cases where the dynamic range determination signal DR is equal to "01", that is, if the dynamic range of one field of input video signal lies within the range of brightness of "91"–"146", the light emission drive format as shown not in FIG. 23C but in FIG. 27, where one field is divided into 4 sub-fields, is employed to drive the PDP 10.

Figure 28:
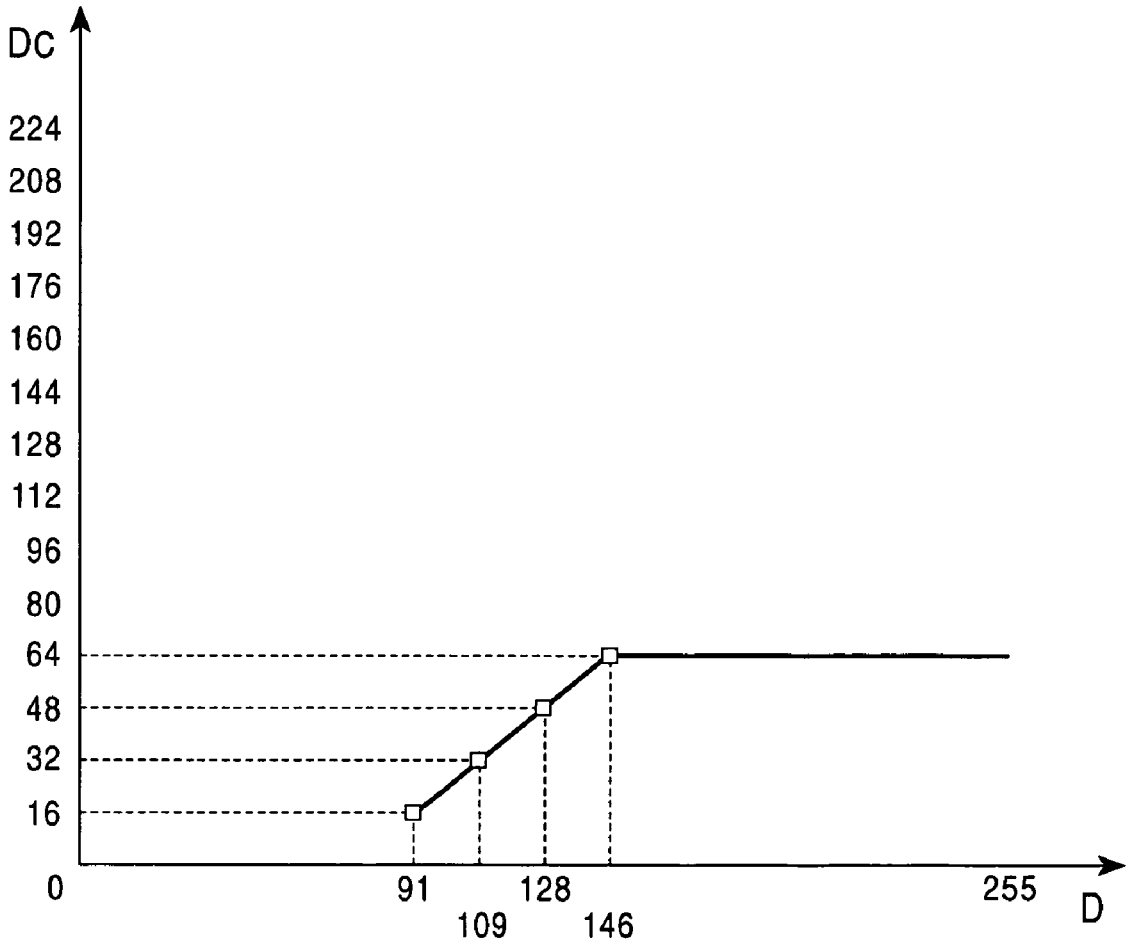
FIG. 28 is view showing the conversion characteristics of a data conversion circuit 354 when a drive is carried out in accordance with the light emission drive format shown in FIG. 27.

The light emission drive format shown in FIG. 27 allows the display period of one field to be divided into four sub-fields comprising sub-fields SF1–SF4, and the simultaneous reset process Rc, pixel data write process Wc, the light emission sustain process Ic, and the erase process E to be carried out, respectively. At this time, the data conversion circuit 354 of the first data conversion circuit 35 shown in FIG. 19 converts the pixel data D into adjusted pixel data Dp using the conversion characteristics shown in FIG. 28 in place of the conversion characteristics as shown in FIG. 22. The multi-level gray scale processing circuit 33 performs the aforementioned multi-level gray scale processing on the adjusted pixel data Dp to determine the multi-level gray scale pixel data Ds. The second data conversion circuit 34 converts the aforementioned multi-level gray scale pixel data Ds into the drive pixel data HD comprising 4 bits using the conversion table shown in FIG. 29 in place of the conversion table shown in FIG. 7, and then supplies the drive pixel data HD to the memory 4, only when a drive is carried out in accordance with the light emission drive format shown in FIG. 27. At this time, the memory 4 writes the aforementioned drive pixel data HD in sequence in accordance with a write signal supplied from the drive control circuit 2. After writing a screenful of data (for n rows and m columns) has been completed in the PDP 10 through such writing action, the memory 4 treats each bit digit of the screenful of drive pixel data $HD_{11\text{-}nm}$ as divided into four drive pixel data bits $DB\mathbf{1}_{11\text{-}nm}$–$DB\mathbf{4}_{11\text{-}nm}$, for example, as shown below.

$DB\mathbf{1}_{11\text{-}nm}$: the first bit of the drive pixel data $HD_{11\text{-}nm}$ $DB\mathbf{2}_{11\text{-}nm}$: the second bit of the drive pixel data $HD_{11\text{-}nm}$ $DB\mathbf{3}_{11\text{-}nm}$: the third bit of the drive pixel data $HD_{11\text{-}nm}$ $DB\mathbf{4}_{11\text{-}nm}$: the fourth bit of the drive pixel data $HD_{11\text{-}nm}$ Then, the memory 4 reads each of $DB\mathbf{1}_{11\text{-}nm}$, $DB\mathbf{2}_{11\text{-}nm}$, $DB\mathbf{3}_{11\text{-}nm}$ and $DB\mathbf{4}_{11\text{-}nm}$ in sequence, line by line, in accordance with a read signal supplied from the drive control circuit 2 and supplies them to the address driver 6.

Therefore, in the case where the dynamic range of one field of the input video signal lies within the range of brightness of "91"–"146", a drive that is carried out using the light emission drive format shown in FIG. 27 in place of the light emission drive format shown in FIG. 23C provides the display brightness of 5 levels of halftone as shown below.

{0, 27, 40, 56, 75}

Figure 30:
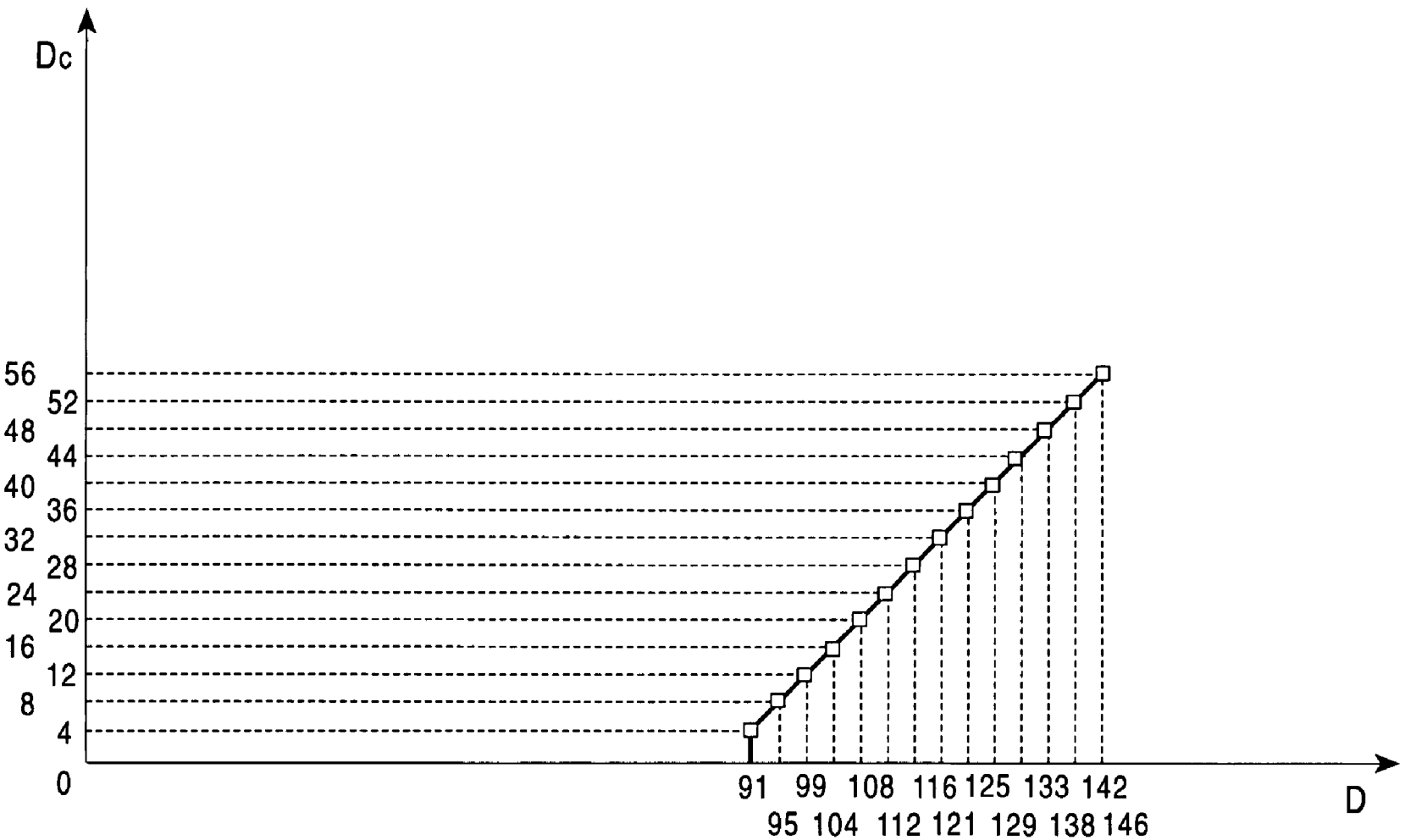
FIG. 30 is a view showing the conversion characteristics of the data conversion circuit 354 when the number of compressed bits provided by the multi-level gray scale processing circuit 33 is reduced from four bits to 2 bits.

As such, the number of divided sub-fields is reduced from 14 to 4, thereby attempting to reduce power consumption. At this time, in the case where the number of compressed bits is reduced from 4 bits to 2 bits to attempt to reduce noise in the error diffusion processing and the dither processing in the multi-level gray scale processing circuit 33, the data conversion circuit 354 shown in FIG. 19 employs the conversion characteristics as shown in FIG. 30, while the second data conversion circuit 34 employs the data conversion table as shown in FIG. 31.

Furthermore, in the aforementioned embodiment, the cases where the so-called selective erase addressing method is employed as the writing method of pixel data has been explained, where wall charge is formed in each discharge cell beforehand at the head of each drive period to set all discharge cells to "light-emitting cells" and then the wall charge is selectively erased in accordance with pixel data in order to write the pixel data.

However, the present invention can also be applied to the cases where the so-called selective write addressing method is employed as the writing method of pixel data in which wall charge is selectively formed in accordance with the pixel data.

FIG. 32A–FIG. 32C show the light emission drive format to be used when the aforementioned selective write addressing method is employed to drive the plasma display device shown in FIG. 1.

As shown in FIG. 32A–FIG. 32C, the light emission drive format in which the selective write addressing method is employed flips from right to left the arrangement of sub-fields of the light emission drive format in which the selective erase addressing method is employed as shown in FIG. 8A–FIG. 8C. That is, the sub-field SF14 is placed at the head sub-field and the sub-field SF1 is placed at the last sub-field. Furthermore, it is the same as the case where the selective erase addressing method is employed as shown in FIGS. 8A–C that the simultaneous reset process Rc, the pixel data write process Wc, the light emission sustain process Ic, and the erase process E are carried out in each sub-field, respectively.

Figure 33:
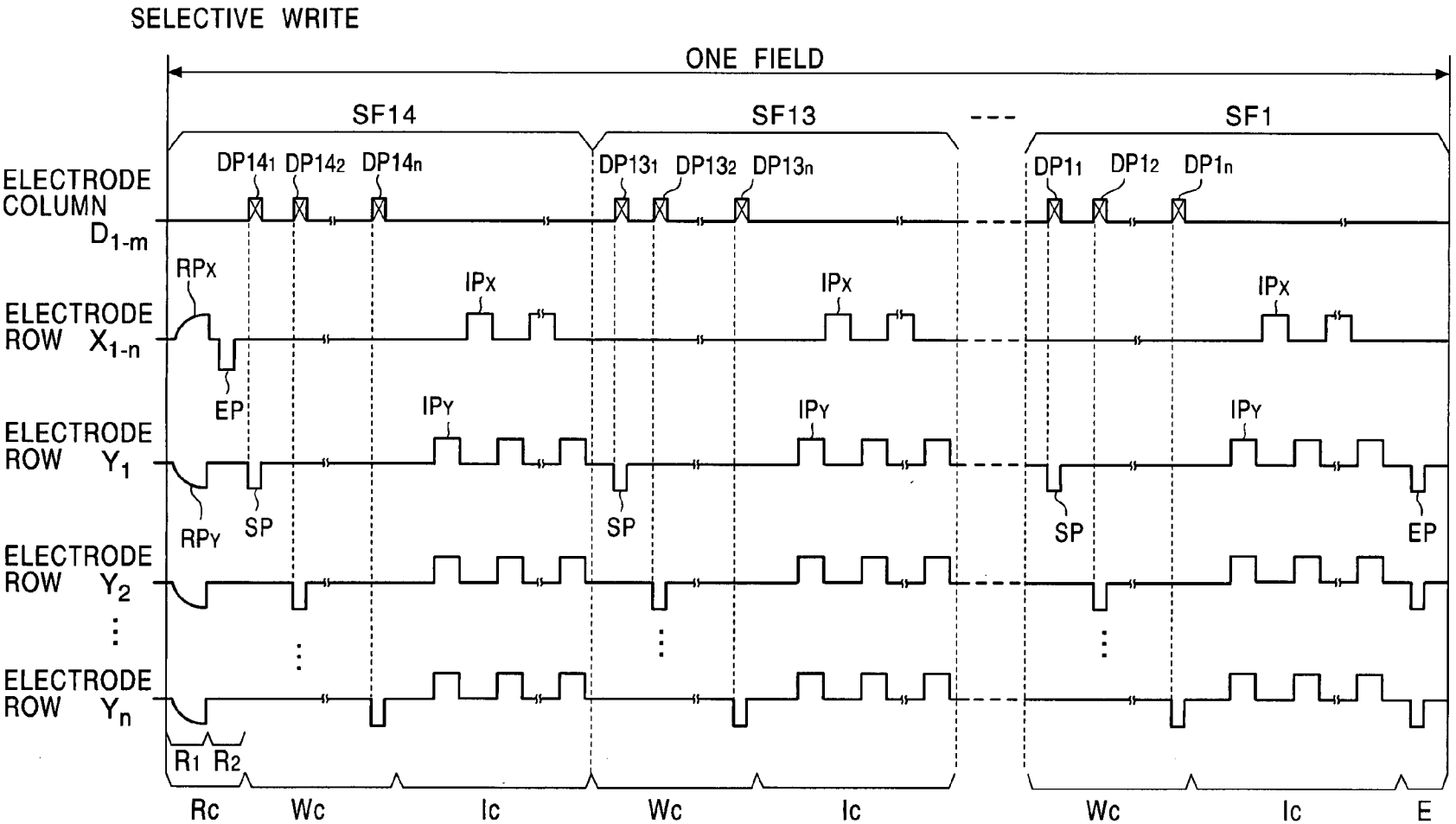
FIG. 33 is a view showing the application timing of various types of drive pulse to be applied to a PDP 10 when a drive is carried out by employing a selective write address method.

FIG. 33 shows the application timing of various types of drive pulses to be applied the PDP 10 by means of the address driver 6, the first sustain driver 7, and the second sustain driver 8, of the plasma display device shown in FIG. 1, when the selective write addressing method is employed.

As shown in FIG. 33, first, in the simultaneous reset process Rc in the head sub-field SF14, each of the first sustain driver 7 and the second sustain driver 8 applies reset pulses RPx, RPy to the electrode rows X, Y of the PDP 10 at the same time. This allows reset discharge to be carried out in all discharge cells of the PDP 10, and thus wall charge is built up compulsorily in respective discharge cells ($R_1$). Immediately thereafter, the first sustain driver 7 applies simultaneously an erase pulse EP to the electrode rows $X_1$–$X_n$ of the PDP 10, thereby generating the erase discharge for erasing the aforementioned wall charge that has been built up in all discharge cells ($R_2$). That is, according to the execution of the simultaneous reset process Rc shown in FIG. 33, all discharge cells in the PDP 10 are reset to the state of "non-light-emitting cells".

Next, in the pixel data write process Wc to be carried out in each sub-field, the address driver 6 generates pixel data pulses that have a voltage corresponding to the logic level of the drive pixel data bit DB read out from the memory 4 and applies the pixel data pulses to the electrode columns $D_{1\text{-}m}$ line by line in sequence. That is, first, in the pixel data write process Wc of sub-field SF14, a data bit corresponding to the first line, that is, $DB\mathbf{14}_{11\text{-}1m}$ is extracted from the aforementioned drive pixel data bits $DB\mathbf{14}_{11\text{-}nm}$. Then a group of pixel data pulses $DP\mathbf{14}_1$ comprising m pixel data pulses corresponding to each of the logic level of $DB\mathbf{14}_{11\text{-}1m}$ is generated and applied to the electrode columns $D_{1\text{-}m}$. Next, $DB\mathbf{14}_{21\text{-}2m}$ corresponding to the second line is extracted from the drive pixel data bits $DB\mathbf{14}_{11\text{-}nm}$. Then a group of pixel data pulses $DP\mathbf{14}_2$ comprising m pixel data pulses corresponding to each of the logic level of $DB\mathbf{14}_{21\text{-}2m}$ is generated and applied to the electrode columns $D_{1\text{-}m}$. Subsequently, likewise, in the pixel data write process Wc of the sub-field SF14, a group of pixel data pulses $DP\mathbf{14}_3$–$DP\mathbf{14}_n$ is applied in sequence to the electrode columns $D_{1\text{-}m}$ line by line. In the pixel data write process Wc of the following sub-field SF13, first, a data bit corresponding to the first line, that is, $DB\mathbf{13}_{11\text{-}1m}$ is extracted from the aforementioned drive pixel data bits $DB\mathbf{13}_{11\text{-}nm}$. Then a group of pixel data pulses $DP\mathbf{13}_1$ comprising m pixel data pulses corresponding to each of the logic level of $DB\mathbf{13}_{11\text{-}1m}$ is generated and applied to the electrode columns $D_{1\text{-}m}$. Next, $DB\mathbf{13}_{21\text{-}2m}$ corresponding to the second line is extracted from the drive pixel data bits $DB13_{11-nm}$. Then a group of pixel data pulses $DP13_2$ comprising m pixel data pulses corresponding to each of the logic level of $DB13_{21-2m}$ is generated and applied to the electrode columns $D_{1-m}$. Subsequently, likewise, in the pixel data write process Wc of the sub-field SF13, a group of pixel data pulses $DP13_3$–$DP13_n$ is applied in sequence to the electrode columns $D_{1-m}$ line by line. Subsequently, likewise, in the pixel data write process Wc in each of sub-field SF12–SF1, each of the groups of pixel data pulses $DP12_{1-n}$–$DP1_{1-n}$ generated based on each of the drive pixel data bits $DB12_{11-nm}$–$DB1_{11-nm}$ is assigned to each of sub-fields SF12–SF1 and applied to the electrode columns $D_{1-m}$ by the address driver 6. Furthermore, it is to be understood that the address driver 6 generates high voltage pixel data pulses when the drive pixel data bit DB has a logic level "1", while generating low voltage pixel data pulses (zero volt) when the drive pixel data bit DB has a logic level "0".

Moreover, in the pixel data write process Wc of each sub-field, the second sustain driver 8 generates scan pulses SP of negative polarity as shown in FIG. 33 at the same timing as the application timing of each of the aforementioned groups of pixel data pulses DP and applies the pulses in sequence to the electrode rows $Y_1$ through $Y_n$. At this time, discharge (selective write discharge) is produced only in the discharge cells located at the intersections of the "rows" to which the scan pulse SP is applied and the "columns" to which a high voltage pixel data pulse is applied, so that wall charge is built up within the discharge cell. That is, the logic level of each of the fourteenth through the first bits of the drive pixel data HD as shown in FIG. 31 is to determine whether the selective write discharge should be generated in the pixel data write process Wc of each sub-field SF14–SF1. This selective write discharge causes the discharge cells that have been reset to the state of a "non-light-emitting cell" at the aforementioned simultaneous reset process Rc to change to a "light-emitting cell". Furthermore, the discharge cells that are formed in the "columns" to which the aforementioned high voltage pixel data pulses have not been applied are provided with no discharge, but are sustained in the state of being reset in the aforementioned simultaneous reset process Rc, that is, to the state of a "non-light-emitting cell".

Next, in the light emission sustain process Ic of each sub-field, the first sustain driver 7 and the second sustain driver 8 apply sustain pulses $IP_X$ and $IP_Y$ of positive polarity alternately as shown in FIG. 33 to the electrode rows $X_1$–$X_n$ and $Y_1$–$Y_n$. Furthermore, the number of the sustain pulses IP that should be applied in the light emission sustain process Ic of each sub-field is the same as that of the case where the aforementioned selective erase addressing method is employed. The application of the sustain pulses IP allows only the discharge cells in which wall charge has been built up in the aforementioned pixel data write process Wc, that is, only the "light-emitting cells" to carry out sustain discharge every time the aforementioned sustain pulses IPx and IPy are applied thereto to sustain the light emission state generated by the discharge for the aforementioned number described in FIG. 32. At this time, the ratio of the number of sustain discharges that should be carried out in each of the sub-fields SF14–SF1 is an inverse γ ratio and the γ characteristic applied to the pixel data D corresponding to the input video signal is released.

Finally, in the erase process E in the last sub-field SF1, the second sustain driver 8 generates the erase pulse EP and then applies the pulse to each of the electrode columns $Y_1$–$Y_n$. The application of the erase pulses EP allows the erase discharge to be generated in all discharge cells, so that the wall charge remaining in all discharge cells disappears. That is, the erase discharge causes all discharge cells in the PDP 10 to change to "non-light-emitting cells".

FIG. 34 shows the data conversion table to be used by the second data conversion circuit 34 when the selective write addressing method is employed to drive the PDP 10, and the all light emission drive patterns to be carried out in accordance with the drive pixel data HD that is converted and outputted in accordance with this conversion table.

Furthermore, the black circles shown in FIG. 34 show that the aforementioned selective write discharge is generated in the pixel data write process Wc of the sub-fields. That is, the selective write discharge is generated only in the sub-fields SF that correspond to the bit digit of logic level "1" of the drive pixel data HD. Light emission is repeated for the number described in FIG. 32 in the light emission sustain process Ic in each of the sub-fields in which this selective write discharge has been carried out and each of the sub-fields (shown by white circles) that are present thereafter.

Therefore, in cases where the peak brightness in one field of the input video signal lies within a range of comparatively high brightness of "183"–"255", a drive is effected in accordance with the light emission drive format shown in FIG. 32A. Thus, the display brightness that is obtained by the light emission drive pattern shown in FIG. 34 becomes the 15 levels shown below. That is,

{0, 1, 4, 9, 16, 27, 40, 56, 75, 97, 122, 151, 182, 217, 256}

Figure 32:
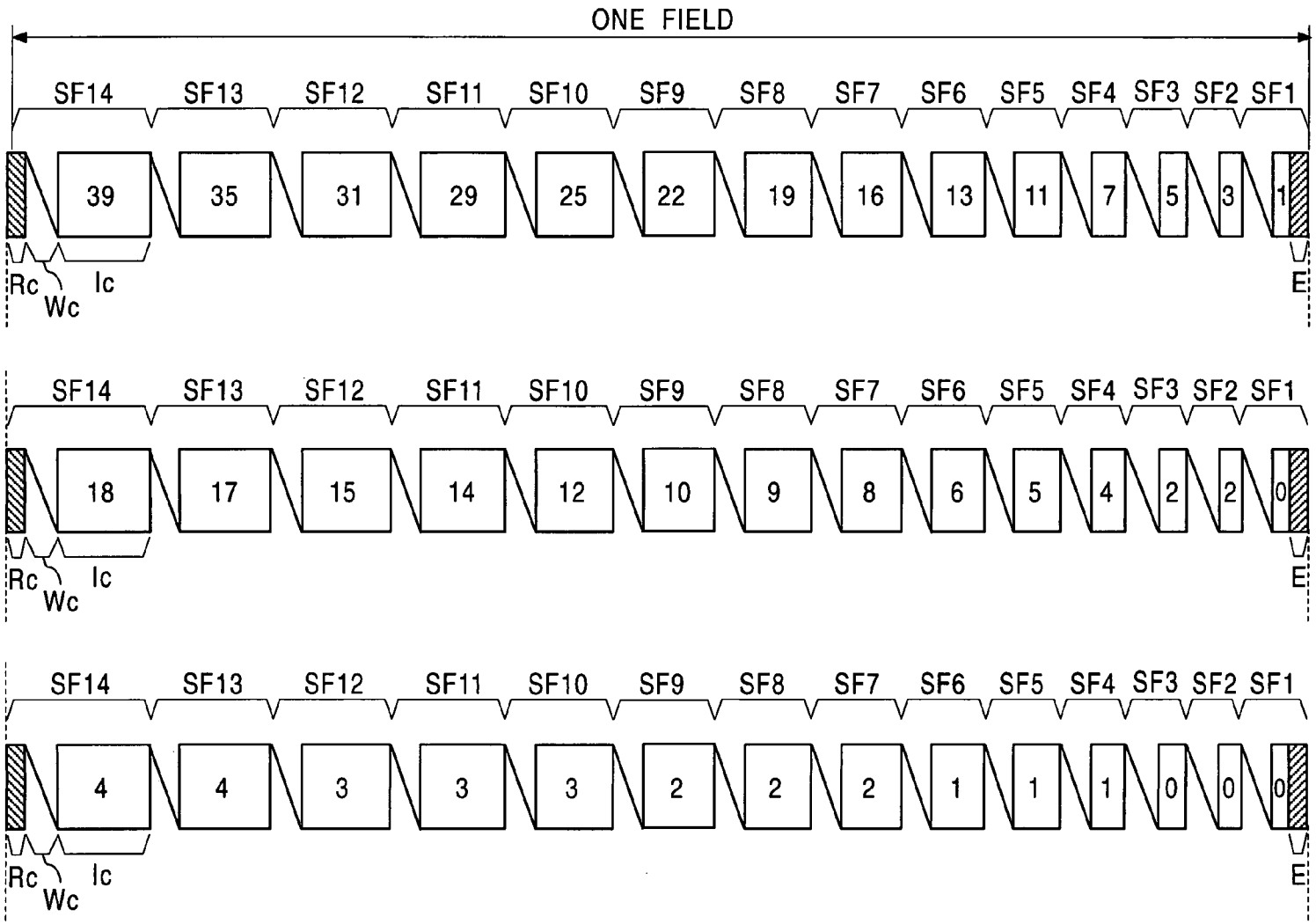
FIG. 32A through FIG. 32C show an example of a light emission drive pattern to be used when a drive is carried out by employing a selective write address method.

On the other hand, in cases where the peak brightness of one field of the input video signal lies within a range of comparatively middle brightness of "92"–"182", a drive is effected in accordance with the light emission drive format shown in FIG. 32 (B). Thus, the display brightness that is obtained by the light emission drive pattern becomes the 14 levels shown below. That is,

{0, 2, 4, 8, 13, 19, 27, 36, 46, 58, 72, 87, 104, 122}

Furthermore, in cases where the peak brightness of one field of the input video signal lies within a range of comparatively low brightness of "0"–"91", a drive is effected in accordance with the light emission drive format shown in FIG. 32C. Thus, the display brightness that is obtained by the light emission drive pattern becomes the 13 levels shown below. That is, {0, 1, 2, 3, 4, 6, 8, 10, 13, 16, 19, 23, 27}

As described above, even in the case where the selective write addressing method is employed as the pixel data write method, if one field of the input video signal lies within a predetermined range of brightness, a halftone drive is carried out within the range of brightness, thereby reducing a difference in brightness between respective levels of halftone and thus providing excellent screen display.

Furthermore, according to the drive pixel data HD shown in FIG. 34, in the pixel data write process Wc of any one of the sub-fields SF14–SF1, the scan pulses SP and the high voltage pixel data pulses are simultaneously applied to allow the selective write discharge to be generated. However, in some cases where there remains less amount of charged particles in discharge cells, the simultaneous application of these pulses would not cause the selective write discharge to be generated, raising such a problem that the writing of pixel data cannot be improperly carried out. Hereupon, in place of the data conversion table and the light emission drive pattern shown in FIG. 34, the data conversion table and the light emission drive pattern shown in FIG. 35 is employed. Furthermore, the "*" shown in FIG. 35 shows that each bit of the drive pixel data HD may take the logic level either "1" or "0". In other words, since the initial selective write discharge may possibly fail to write pixel data, the pixel data is positively written by generating the selective write discharge again in at least one of the sub-fields that are present thereafter.

As described above in detail, the method for driving a plasma display panel according to the present invention changes the number of light emissions that should be carried out in the light emission sustain process of each sub-field, in accordance with the peak brightness of the input video signal. Accordingly, the method is adapted to carry out such a halftone drive that covers only a predetermined range of brightness that is expected by the peak brightness.

Therefore, the method for driving enables reducing a difference in brightness between respective levels of halftone, thereby providing excellent levels of halftone.

What is claimed is:

1. A method for driving a display panel with a plurality of pixel cells formed therein in accordance with a video signal, comprising:

a resetting step for resetting all of said pixel cells into a light-emitting cell state only in one of a plurality of divided display periods at a head position of a unit display period, said plurality of divided display periods constituting said unit display period;

a writing step for selectively setting said pixel cells to a non-light-emitting cell state in accordance with pixel data corresponding to said video signal only in one of said divided display periods;

a light emitting step for allowing only pixel cells in said light-emitting cell state to emit light a number of light emitting times assigned correspondingly to each of weights assigned to said respective divided display periods a brightness range measuring step for measuring a range of brightness of said video signal for each said unit display period;

a light emission number changing step for changing said number of light emitting times to be assigned to said one of divided display periods at the head position, in accordance with said range of brightness of said video signal measured in said brightness range measuring step, wherein in said light emission number changing step said number of light emitting times assigned to said one of said divided display periods at the head position is changed in such a way that said number of light emitting times increases as a lowest brightness level in said range of brightness rises.

2. A method for driving a display panel according to claim 1, wherein a total number of light emitting times within said unit display period corresponds to a maximum brightness level in said range of brightness of said video signal.

3. A method for driving a display panel according to claim 1, wherein in a case where said range of brightness is narrower than a predetermined value, a number of divided display periods, into which said unit display period is divided, is reduced.

4. A method for driving a display panel according to claim 1, wherein multi-level gray scale processing comprising error diffusion processing and/or dither processing is performed on said pixel data.

5. A method for driving a display panel with a plurality of pixel cells formed therein in accordance with a video signal, comprising:

a resetting step for resetting all of said pixel cells into a light-emitting cell state only in one of a plurality of divided display periods at a head position of a unit display period, said plurality of divided display periods constituting said unit display period;

a writing step for selectively setting said pixel cells to a non-light-emitting cell state in accordance with pixel data corresponding to said video signal only in one of said divided display periods;

a repeated writing step for setting said pixel cells that have been set to said non-light-emitting cell state repeatedly to said non-light emitting cell state in one of said divided display periods which follow said one of said divided display periods;

a light emitting step for allowing only pixel cells in said light-emitting cell state to emit light a number of light emitting times assigned correspondingly to each of weights assigned to said respective divided display periods;

a brightness range measuring step for measuring a range of brightness of said video signal for each said unit display period;

a light emission number changing step for changing said number of light emitting times to be assigned to said one of divided display periods at the head position, in accordance with said range of brightness of said video signal measured in said brightness range measuring step, wherein in said light emission number changing step said number of light emitting times assigned to said one of said divided display periods at the head position is changed in such a way that said number of light emitting times increases as a lowest brightness level in said range of brightness rises.

6. A method for driving a display panel according to claim 5, wherein in a case where said range of brightness is narrower than a predetermined value, a number of divided display periods, into which said unit display period is divided, is reduced.

7. A method for driving a display panel according to claim 5, wherein multi-level gray scale processing comprising error diffusion processing and/or dither processing is performed on said pixel data.

* * * * *